US012765658B1

(12) United States Patent
Gilani et al.

(10) Patent No.: US 12,765,658 B1
(45) Date of Patent: Oct. 20, 2026

(54) PERFUME DISPENSING SYSTEM

(71) Applicants: Ahmed Zaid Gilani, Wayland, MA (US); Talat Shagufta Kazmi, Wayland, MA (US); Syed Mohammad Waqas Gilani, Wayland, MA (US); Fahad Syed Gilani, Wethersfield, CT (US); Tooba Gilani, Wayland, MA (US); Sana Gilani, Wayland, MA (US)

(72) Inventors: Ahmed Zaid Gilani, Wayland, MA (US); Talat Shagufta Kazmi, Wayland, MA (US); Syed Mohammad Waqas Gilani, Wayland, MA (US); Fahad Syed Gilani, Wethersfield, CT (US); Tooba Gilani, Wayland, MA (US); Sana Gilani, Wayland, MA (US)

( * ) Notice: Subject to any disclaimer, the term of this patent is extended or adjusted under 35 U.S.C. 154(b) by 580 days.

(21) Appl. No.: 18/102,267

(22) Filed: Jan. 27, 2023

Related U.S. Application Data

(60) Provisional application No. 63/336,356, filed on Apr. 29, 2022.

(51) Int. Cl.
*A45D 34/04* (2006.01)
*A45D 34/00* (2006.01)

(52) U.S. Cl.
CPC ..... *A45D 34/041* (2013.01); *A45D 2034/005* (2013.01); *A45D 2200/055* (2013.01); *A45D 2200/10* (2013.01)

(58) Field of Classification Search
CPC ..... A45D 34/041; B43M 11/085
(Continued)

(56) References Cited

U.S. PATENT DOCUMENTS 1,670,458 A 5/1928 Boeuf
1,714,030 A * 5/1929 Le Boeuf ..... B65D 47/248 401/214
(Continued)

FOREIGN PATENT DOCUMENTS

DE 10041246 A1 * 3/2002 ..... A45D 34/041
EP 0832578 A2 4/1998
(Continued)

OTHER PUBLICATIONS

DE 10041246 A1 Machine Translation (Year: 2002).*

*Primary Examiner* — David P Angwin
*Assistant Examiner* — Bradley S Oliver
(74) *Attorney, Agent, or Firm* — John Rizvi; John Rizvi, P.A.—The Patent Professor®

(57) ABSTRACT

A portable perfume dispenser system comprises a perfume dispenser cap and body. A perfume dispenser reservoir, a perfume delivery mechanism, and a removable perfume applicator are provided in the perfume dispenser body. The reservoir may removably receive a replaceable or refillable perfume cartridge. The system may further comprise a refilling mechanism. The delivery mechanism may comprise an actuation knob which drives a piston to push perfume out of the cartridge to the delivery mechanism. The delivery mechanism may comprise a port, nozzle, and/or rollerball delivery element. The refilling mechanism may comprise a vacuum-based extraction system used to refill the reservoir or cartridge from a larger bottle, which may include a removable refill adapter. The cap may include a socket configured to receive, retain, and rotate the applicator to unscrew the applicator for removal from the dispenser body. The dispensing system may be portable, and provides ease of use and refilling.

21 Claims, 15 Drawing Sheets

(58) Field of Classification Search
USPC ..... 401/172, 208–217
See application file for complete search history.

(56) References Cited

U.S. PATENT DOCUMENTS

| | | | | | |
|---|---|---|---|---|---|
| 1,875,184 | A * | 8/1932 | Steigleder | B43L 19/0018 | 401/214 |
| 2,122,580 | A | 7/1938 | Morris | | |
| 2,258,841 | A * | 10/1941 | Biro | B43K 1/08 | 401/214 |
| 2,807,817 | A * | 10/1957 | Ackerman | A45D 34/041 | 401/213 |
| 2,867,357 | A | 1/1959 | Schneider et al. | | |
| 3,100,477 | A * | 8/1963 | Ermel | B43K 7/04 | 401/209 |
| 4,094,610 | A * | 6/1978 | Larson | B43K 15/00 | 401/209 |
| 4,493,575 | A * | 1/1985 | Mutschler | B43M 99/007 | 211/69.8 |
| 4,595,308 | A * | 6/1986 | Schiefnetter | B43K 8/16 | 401/242 |
| 4,952,090 | A * | 8/1990 | Richardson | A45D 34/041 | 401/209 |
| 5,492,248 | A | 2/1996 | Ortner | | |
| 5,526,960 | A * | 6/1996 | Breidenbach | A45D 34/041 | 222/325 |
| 5,586,694 | A | 12/1996 | Breidenbach et al. | | |
| 6,409,405 | B1 * | 6/2002 | Eddington | B43K 5/06 | 401/174 |
| 6,880,999 | B2 * | 4/2005 | Biegel | A45D 34/04 | 401/174 |
| 8,079,388 | B2 | 12/2011 | Turgeman | | |
| 9,414,664 | B2 | 8/2016 | Irving et al. | | |
| 9,993,059 | B2 | 6/2018 | Langdon et al. | | |
| 10,011,402 | B2 | 7/2018 | Hui et al. | | |
| 10,123,607 | B1 | 11/2018 | Hardy | | |
| 10,279,362 | B2 | 5/2019 | Tu | | |
| 10,531,721 | B2 | 1/2020 | Crawford et al. | | |
| 10,625,286 | B2 | 4/2020 | Detsh et al. | | |
| 10,850,292 | B2 | 12/2020 | Lecoutre | | |
| 2013/0092285 | A1 | 4/2013 | Feriani et al. | | |
| 2014/0224897 | A1 | 8/2014 | Garagnon et al. | | |
| 2017/0100733 | A1 | 4/2017 | Okhai et al. | | |
| 2017/0127793 | A1 | 5/2017 | Toh et al. | | |
| 2017/0216519 | A1 | 8/2017 | Vouillamoz et al. | | |
| 2017/0224086 | A1 | 8/2017 | Relf | | |
| 2018/0228267 | A1 | 8/2018 | Relf | | |
| 2020/0345122 | A1 | 11/2020 | Groffsky et al. | | |

FOREIGN PATENT DOCUMENTS

| | | | | |
|---|---|---|---|---|
| EP | 3162586 | A1 * | 5/2017 | B43K 11/00 |
| GB | 2304644 | A | 3/1997 | |
| WO | WO2002052977 | A2 | 7/2002 | |

* cited by examiner

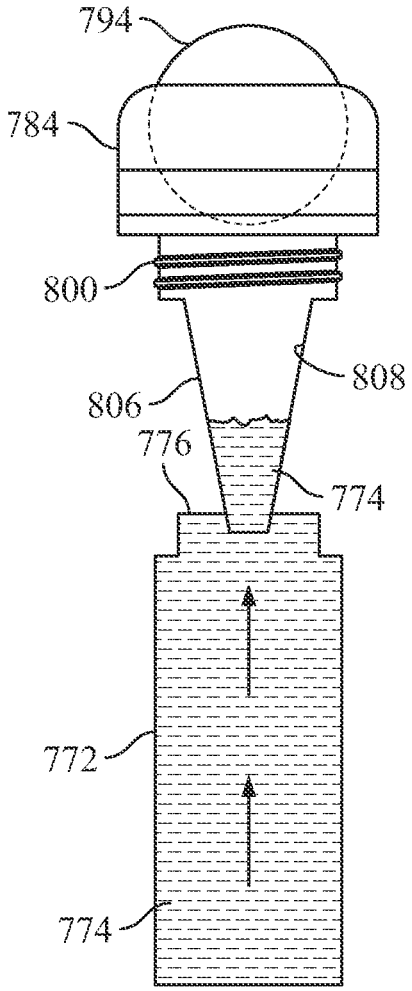
FIG. 28
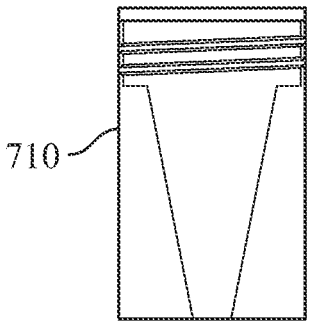
FIG. 29
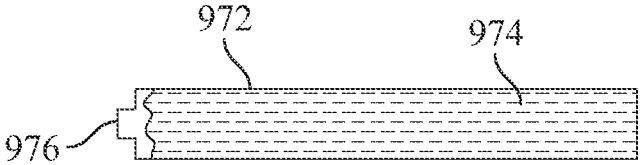
FIG. 30.1
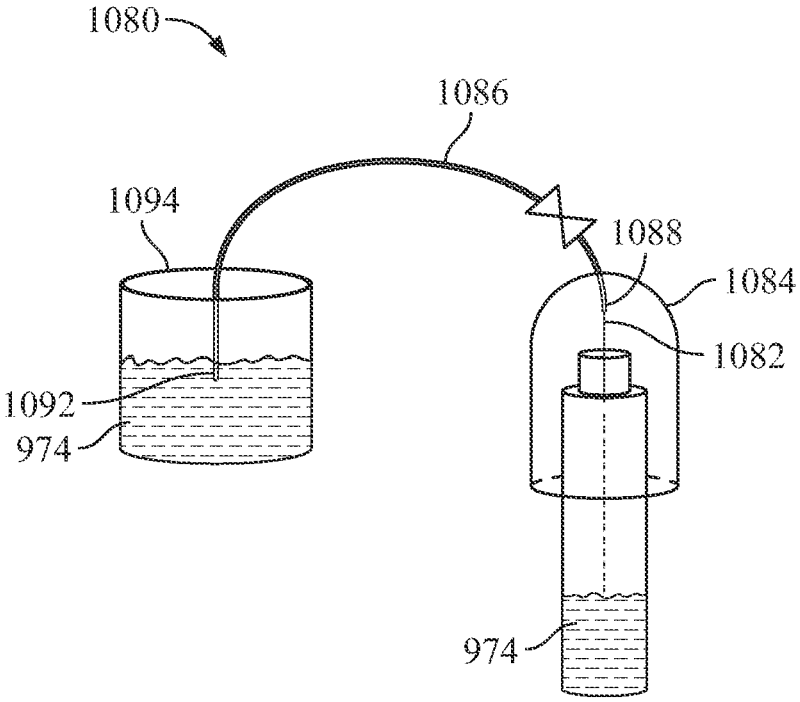
FIG. 30.2

PERFUME DISPENSING SYSTEM

CROSS-REFERENCE TO RELATED APPLICATIONS

This application claims the benefit of U.S. Provisional Patent Application No. 63/336,356, filed on Apr. 29, 2022, which is incorporated by reference herein in its entirety.

FIELD OF THE INVENTION

The present invention relates generally to dispensers, and more particularly, to a refillable perfume dispensing system.

BACKGROUND OF THE INVENTION

Liquid dispensers exist for various materials such as ink, which may include a spring-loaded roller ball associated with a normally closed valve capable of opening to enable ink to flow when the roller ball is pressed on the object to which ink is being applied, and sealing itself when the roller ball is withdrawn away from object upon which the ink is being applied.

Fluid applicators may be used to topically apply fluids including liquids, gels, viscous oils, ointments, and medications directly to body surfaces such as the human skin or membranes. However, fluid applicators may cause complications in application of the topical fluids. The applicator may leak, drip, provide uneven application, create undue waste, or cause inconvenience to the user.

Some dispensers exist which have roll-on dispensing balls, which work best with thick or pasty roll-on materials, since the circumferential edge around the roller ball will otherwise leak a liquid material.

Refillable atomizers are capable of use only with alcohol-based perfumes.

Fluid applicators may be used to topically apply perfumes. Perfume dispensers exist in the form of disposable, single use pen-shaped perfume dispensers, which include saturated felt-tip pen interior pads with pointed, nib points also similar to a felt-tip pen or highlighter. The composition of liquid perfume and its volatility makes use of such a dispenser difficult. Sealing a perfume dispenser remains problematic, and leakage of the liquid perfume from the dispenser will occur without proper sealing structures being provided. Further, such dispensers quickly dry out as the perfume evaporates.

Other types of liquid perfume dispensers may include spring-loaded roll-on dispensers, which have a refillable liquid perfume cartridge that includes these problems of perfume leaking and evaporating. Such dispensers must be carefully refilled filled for re-use, via a funnel and pour spout, or with an eyedropper.

Existing roll-on applicators must provide tight seal between the ball and the reservoir container holding the material to be applied. In some applicators a seating obtained may be molded to the reservoir which is capable of supporting a spherical ball mounted freely for rotation therein. To prevent the leakage, a cap may be configured to cover the ball when mounted on the applicator and press the ball inward against the seating in a leak-tight manner. The leak-tight arrangement is provided only when the cap is in place and securely engages the ball against the seating. If the cap, ball, and seating are irregular or damaged in manufacture or assembly, or if the cap is not properly replaced by the end-user, leakage and evaporation will occur.

Some applicators may simply be made to be disposable, or are single-use applicators. In such applicators, a ball-type application head and cap may be permanently affixed to a reservoir of liquid for topical application in a manner that prevents refilling or replacement. Where application of a different topical fluid is required, or desired, the replacement of such in an accessible applicator may not be available. The cartridges are designed to be disposable as opposed to user-refillable.

Some commercially available dispensers for perfumes, aftershave and similar products are covered with protective/decorative cases. The protective/decorative cases may include a bottom protective/decorative cover portion and a top protective/decorative cover portion capable of being removably placed over a bottom fixed cover, and a cap, respectively. The decorative cases may be removable and replaceable, but are likewise easily worn-out or broken with repeated use, and ultimately detract from the usefulness of the dispenser element or nozzle. Further, the protective/decorative case may be difficult to remove, and may interfere with access to a dispenser refilling mechanism. Frequent attempts to remove the cap for dispensing might instead loosen the top protective/decorative cover, causing annoyance and inconvenience, which would interfere with use of the dispenser. In addition, if the dispenser cover has a threaded connection between the dispenser and the cap, a protective/decorative cover may interfere with alignment of threads on the cover and on the dispenser in order to allow the screwing of the cover onto the dispenser which may take some time.

Ideally, it would be extremely useful to have a perfume dispensing system capable of use with multiple replaceable cartridges or refillable cartridges. It would further be useful to have such a dispensing system capable of use with multiple types of perfume compositions. It would also be useful to have a dispensing system with a refilling system that is able to preserve perfume compositions.

Accordingly, there is need for a solution to at least one of the aforementioned problems. For instance, there is an established need for a perfume dispensing system which may be refillable, and may accommodate replaceable or refillable cartridges. There is a need for a perfume dispensing system which may be used with multiple types of perfume compositions. There is a further need for a dispenser with a reliable delivery system. There is an additional need for a dispenser with a reliable mechanism for easy refilling. There is also a need for a perfume dispensing system which may be portable.

SUMMARY OF THE INVENTION

The present invention provides a portable perfume dispensing system which may be refillable and may accommodate replaceable or refillable cartridges. The perfume dispensing system may be used with multiple types of perfume compositions. The system includes a dispenser with a reliable delivery system. The system further includes reliable mechanism for easy refilling.

Accordingly, in an exemplary application, the portable perfume dispensing system may comprise a perfume dispenser body and a perfume dispenser cap. The cap may be removably placed on the perfume dispenser body. The perfume dispensing system may include a perfume dispenser reservoir, a perfume delivery mechanism, and a removable threaded perfume applicator provided in the perfume dispenser body. The reservoir may removably receive a replaceable or refillable perfume cartridge. The system may further comprise a refilling mechanism. The cap may include a socket configured to receive, retain, and rotate the applicator to unscrew the applicator for removal from the dispenser body. The perfume dispensing system may be portable and provides ease of use and refilling.

In one aspect, the delivery mechanism may comprise an actuation knob which drives a piston to push perfume out of the cartridge to the delivery mechanism.

In one aspect, the delivery mechanism may comprise a port or nozzle, or a rollerball delivery element.

In one aspect, the refilling mechanism may comprise a vacuum-based extraction system capable of use to refill the reservoir or cartridge from a larger bottle.

In an exemplary application the perfume dispensing system may comprise:

- a perfume dispenser body having a perfume dispenser body top portion, a perfume dispenser body first end, a perfume dispenser body bottom portion, a perfume dispenser body second end, and a perfume dispenser body intermediate portion;
- a perfume reservoir located in the perfume dispenser body;
- a perfume delivery system located in the perfume dispenser body, the perfume delivery system being operatively connected to the perfume reservoir;
- a perfume applicator comprising an upper applicator portion, an intermediate applicator portion, and a lower threaded portion configured to be screwed into and removably retained in the top portion of the dispenser body, the perfume applicator in fluid communication with the perfume reservoir and the perfume delivery system, the perfume applicator further comprising a gasket located the intermediate applicator portion, the gasket configured to provide a seal between the perfume applicator and the upper dispenser housing when the perfume applicator is screwed into the dispenser; and
- a perfume dispenser cap having a perfume dispenser cap top portion, a perfume dispenser cap first end, a perfume dispenser cap bottom portion, a perfume dispenser cap second end; and a perfume dispenser cap intermediate portion, the perfume dispenser cap top portion further comprising a cap socket configured to receive and retain the upper applicator portion so the perfume dispenser cap may be used as a socket wrench to rotate the perfume applicator to unscrew the perfume applicator for removal from the top portion of the dispenser body.

In one aspect the system may include a removable perfume cartridge, which may be replaceable or refillable. The cartridge may be compatible with or contain multiple types of perfume compositions. The perfumes may be oil-based perfume compositions or alcohol-based perfume compositions. The perfume dispensing system may comprise a reliable and durable delivery mechanism to provide ease of use. The perfume dispensing system may further comprise a reliable and durable refilling mechanism, to provide ease in refilling.

In one aspect, the perfume dispensing system may have a delivery mechanism comprising an actuation knob which drives a piston capable of pushing perfume out of the cartridge to a delivery element at the top of the dispenser.

In one aspect, the perfume delivery element may comprise a delivery port, a delivery nozzle, or a perfume applicator located at the top of the dispenser. The delivery element may alternatively comprise a roller-ball-type delivery element.

In one aspect, the perfume dispenser system may comprise a delivery system or delivery mechanism. The delivery mechanism may comprise a piston mechanism which comprises an actuation knob operably connected to a piston capable of pushing perfume out of the reservoir or the cartridge, so that in response to actuation of the actuation knob by a user, the actuation knob drives the piston, and the piston pushes perfume out of the reservoir or the cartridge to a dispensing mechanism or a perfume delivery element at a top portion of the dispenser. The dispensing mechanism or perfume delivery element may comprise a delivery port or a delivery nozzle located at the top of the dispenser. The delivery element may alternatively comprise a perfume applicator. The delivery element may comprise a rollerball-type delivery element or dispensing mechanism, or a rollerball applicator.

In one aspect, the perfume dispensing system may comprise a vacuum-based extraction system capable of use to refill a refillable cartridge from a larger perfume bottle.

In one aspect, the perfume dispensing system may be configured to receive replaceable or refillable perfume cartridges. The perfume cartridges may be compatible with both oil-based and alcohol-based perfumes.

In one aspect, the perfume dispensing system and the perfume cartridges may be portable.

In one aspect, the perfume dispenser system may have a cylindrical overall shape, and may comprise a perfume dispenser body and a perfume dispenser cap. A perfume cartridge is carried in the perfume dispenser body. The perfume dispenser body may include a perfume dispenser body top portion, a perfume dispenser body first end, a perfume dispenser body bottom portion. a perfume dispenser body second end, and a perfume dispenser body intermediate portion. The perfume dispenser cap may have a perfume dispenser cap top portion, a perfume dispenser cap first end, a perfume dispenser cap bottom portion, a perfume dispenser cap second end, and a perfume dispenser cap intermediate portion.

In one aspect, the perfume dispenser system may comprise a piston dispensing mechanism located in the perfume dispenser body. The piston dispensing mechanism may comprise a rotatable knob, a rod housing configured to hold a reciprocating rod that carries a piston. The rod housing of the piston dispensing mechanism is in fluid communication with a reservoir for holding a fluid perfume composition. In some embodiments, the rod housing and the reservoir are coextensive, and are separated by the piston. In response to the rotation or "dialing" of the knob, the piston dispensing system pushes upward on the perfume conveying the perfume to the dispenser.

In one aspect, the dispenser includes a rollerball applicator comprising a rollerball retained for rolling movement in a rollerball housing. The rollerball housing has an upper rollerball retainer, a central tubular fluid conduit, and lower exterior threads. The rollerball housing is configured to be screwed into and removably retained in the top portion of the dispenser body. The rollerball housing further includes a series of intermediate openings disposed in a rollerball housing intermediate portion located below the upper rollerball retainer and above the lower exterior threads.

In one aspect, the cap may include a cap clip which may be used as a pocket clip for the perfume dispenser system.

In one aspect, the dispenser cap includes a socket at the cap top end. The cap socket is configured to receive and retain the rollerball and the upper rollerball retainer so the dispenser cap may be used as a socket wrench to rotate the rollerball housing to unscrew the rollerball and rollerball housing from the top portion of the dispenser body. The intermediate openings in the rollerball housing may thereby be exposed so that when the dispenser first end is submerged in a container of perfume, the intermediate openings may pull the perfume into the reservoir to refill the dispenser.

In one aspect, the rollerball housing has a shape that is configured to fit into the cap socket. The rollerball housing further comprises a gasket located below the upper rollerball retainer. The gasket provides a seal between the rollerball housing and the upper dispenser housing when the rollerball housing is screwed into the dispenser. The intermediate openings of the rollerball housing are located below the gasket and above the lower rollerball housing threads to that when the rollerball housing is unscrewed, the intermediate openings may be exposed and used to pull in liquid during refilling of the dispenser. The rollerball housing is further provided with a raised lip below the lower rollerball housing threads. The raised lip is configured to hold the rollerball housing in the upper dispenser and prevent the rollerball housing from coming out of the dispenser when partially unscrewed for refilling of the dispenser.

In one aspect, the perfume dispensing system may have a refillable perfume reservoir, or may be configured to receive a perfume cartridge that is removable and replaceable, and refillable.

In one aspect the perfume dispenser system may comprise a dispenser body which includes a window for use to monitor the fluid level in the reservoir or the cartridge.

In one aspect, the perfume dispenser may be a piston-based perfume dispenser.

In one aspect, the system may include a vacuum-based extraction system capable of use to refill a perfume reservoir or a perfume cartridge with perfume from a larger perfume bottle.

In one aspect, the perfume dispenser may comprise a rollerball applicator having a rollerball housing with intermediate openings as described. The perfume dispenser may further comprise a vacuum-based delivery system or delivery mechanism, and a vacuum-based refilling mechanism. The dispenser may comprise a vacuum-fillable reservoir or a vacuum-fillable cartridge that may be filled or refilled by a user as needed with perfume or another liquid. The perfume dispenser body includes a perfume reservoir having a reservoir chamber with an interior surface. The delivery mechanism may comprise a threaded handle located at the bottom portion of the dispenser body which is configured to be removably retained in the second end of the dispenser body. The threaded handle is operably connected to a rod. The rod has a first rod end and a second rod end. The threaded handle is connected to the second rod end. The threaded handle may be unscrewed and pulled from the dispenser body thereby pulling the rod out of the dispenser body. The first end of the rod is operatively connected to a disc. The disc has an outer edge which contacts the interior surface of the reservoir chamber. When a user is ready to refill the reservoir, the handle may be unscrewed, and the rod may be pulled or pushed to move the disc. When the disc is pulled up and then pushed down the disc movement creates a vacuum pressure in the reservoir chamber like a plunger of a syringe. When disc is pushed beyond a flared section of perfume dispenser body the vacuum pressure is released and liquid may be pulled into the reservoir chamber. When the intermediate openings of the rollerball housing are exposed, and the first end of the dispenser is submerged in the perfume, the release of the vacuum pressure results in the perfume being pulled through the intermediate openings of the rollerball housing and into the reservoir.

In one aspect, the perfume dispenser may provide a refillable reservoir. Cartridges may be separately provided which are capable of being installed in the dispenser body and may be attachable by a retention pin provided in the dispenser body housing of the perfume dispenser. In accordance with the present invention, the cartridges may be pre-filled or filled one time with a user's perfume of choice using a vacuum-based extraction system.

In one aspect, the dispenser cap includes a socket depression on the top shaped to mate with the roller ball applicator housing to hold the roller ball applicator housing for partial removal to expose specialized small openings provided on the side of the rollerball housing in fluid communication with the reservoir and capable of use to refill the reservoir.

In one aspect, the perfume dispenser may comprise a dispenser body with exterior threads at the first end thereof, and the dispenser cap may include interior threads configured for removable securement of the dispenser cap to the dispenser body. The perfume dispenser system may further comprise a refill adapter with interior threads, configured to be removably installed on the dispenser body for use in refilling the perfume dispenser system. The refill adapter may comprise a funnel-shaped pipette tip adapter configured to retrieve perfume from a container such as a narrow neck perfume bottle. The refill adapter is configured for use with the delivery mechanism and may be operated to refill the dispenser by rotation of the actuation knob in a direction opposite the direction the knob is rotated for perfume delivery. The refill adapter may be used to refill the dispenser with perfume from perfume bottles or containers of various sizes with different sized openings.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 28 presents a partial cross-sectional view of the rollerball housing and the perfume cartridge as in FIG. 25, enlarged to show detail;

FIG. 29 presents a partial side cross-sectional view of the top portion of the dispenser body as in FIG. 25, enlarged to show detail;

FIG. 30.1 provides a side elevation view of a pre-filled cartridge;

FIG. 30.2 presents a schematic view of an apparatus and method for filling a vacuum cartridge with perfume in accordance with a sixth embodiment of the present invention;

Like reference numerals refer to like parts throughout the several views of the drawings.

DETAILED DESCRIPTION

Figure 1:
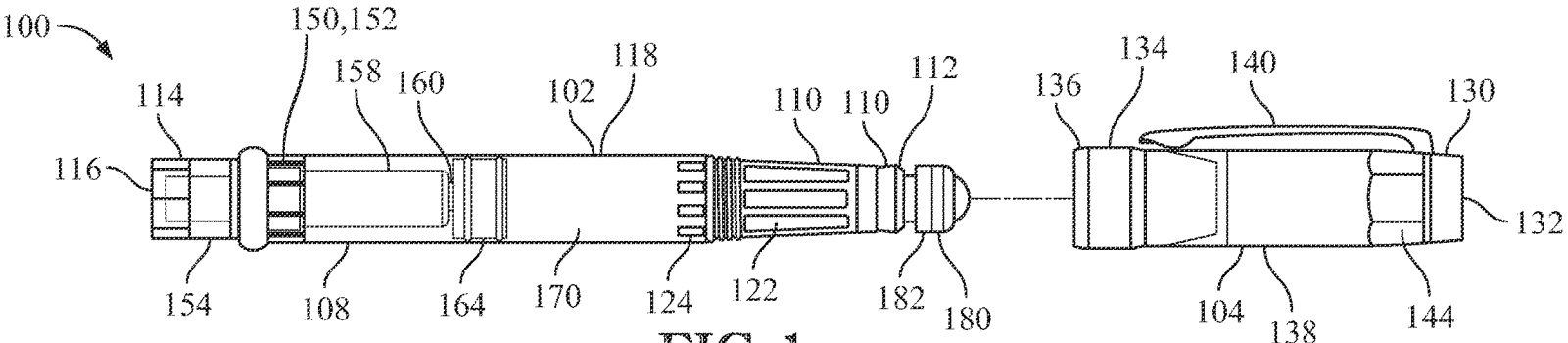
FIG. 1 presents a side elevation view of the dispenser in accordance with a first illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed a portable perfume dispensing system (or perfume dispenser system) which may be refillable and may accommodate replaceable or refillable cartridges. The perfume dispensing system may be used with multiple types of perfume compositions. The system includes a dispenser with a reliable delivery system. The system further includes reliable mechanism for easy refilling.

Referring initially to FIGS. 1-6 a perfume dispenser system in accordance with a first illustrative embodiment is shown. The perfume dispenser system 100 may have a cylindrical overall shape, and may comprise a perfume dispenser body 102 and a perfume dispenser cap 104. A perfume receptacle 108 is provided in the perfume dispenser body 102. The perfume dispenser body may include a perfume dispenser body top portion 110, a perfume dispenser body first end 112, a perfume dispenser body bottom portion 114, a perfume dispenser body second end 116, and a perfume dispenser body intermediate portion 118.

Figure 2:
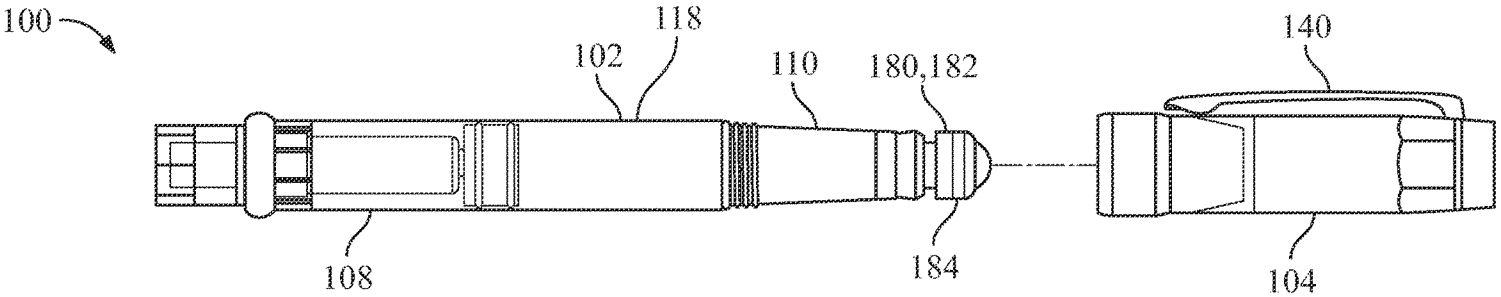
FIG. 2 presents a side elevation view of the dispenser as in FIG. 1 with an alternative exterior.
Figure 3:
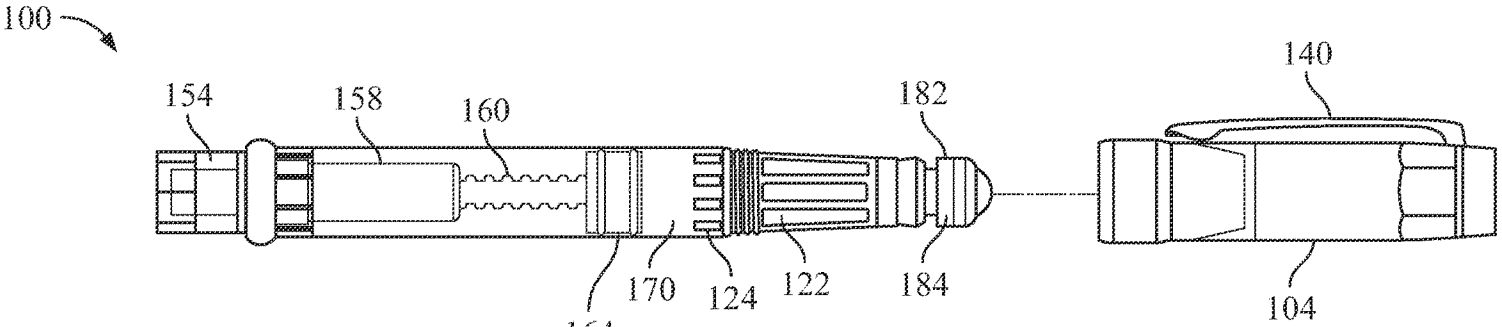
FIG. 3 presents a side elevation view of the dispenser as in FIG. 1 showing the piston advanced in response to actuation of the knob to dispense perfume.
Figure 4:
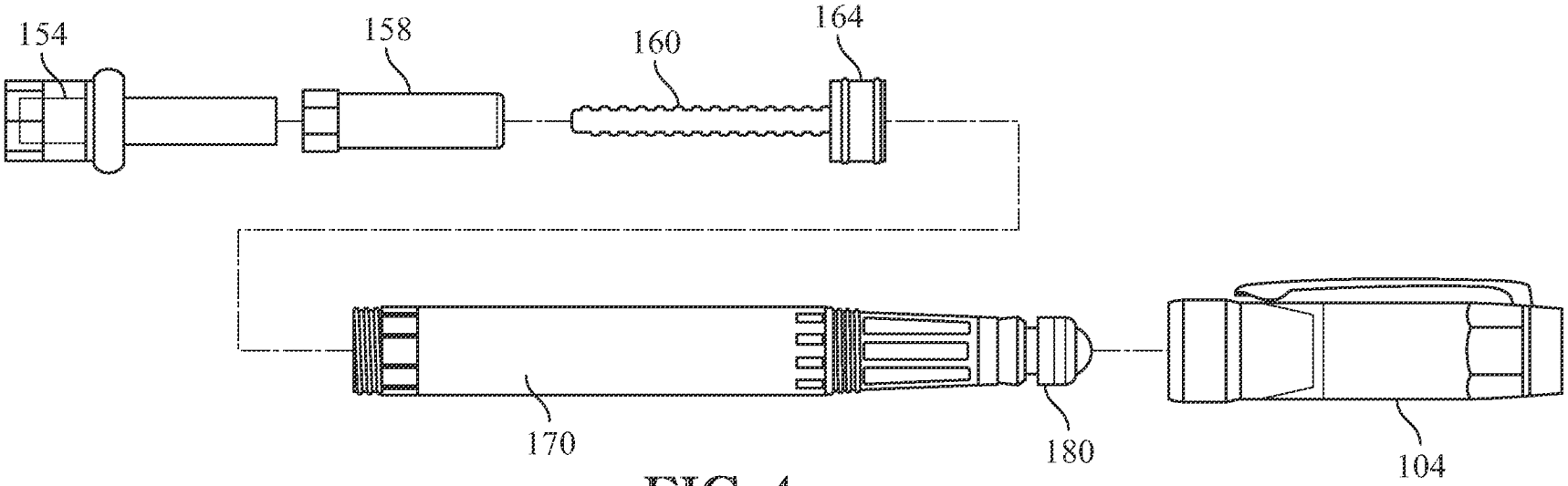
FIG. 4 presents an exploded side elevation view of the dispenser as in FIG. 1.
Figure 5:
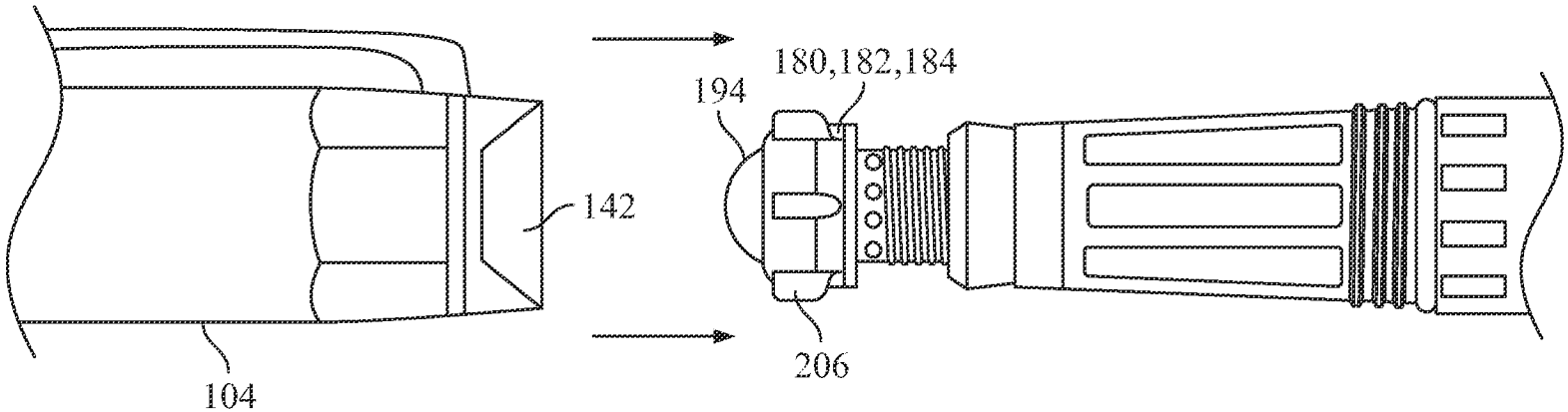
FIG. 5 presents a partial side elevation view enlarged to show detail, showing a dual function of the dispenser cap.
Figure 6:
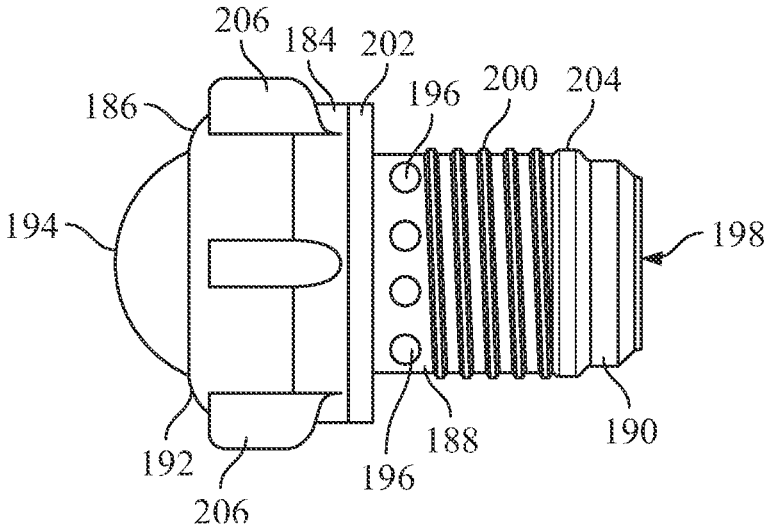
FIG. 6 presents a side elevation view of a roller ball housing and roller ball of the dispenser.
Figure 7:
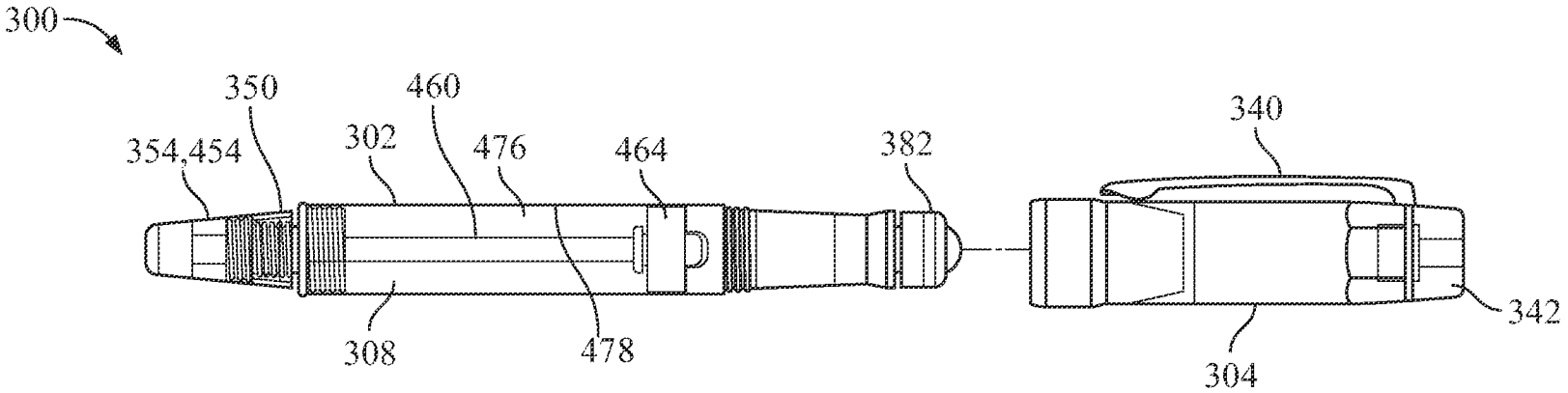
FIG. 7 presents a side elevation view of the dispenser in accordance with a second illustrative embodiment of the present invention which comprises a vacuum mechanism.

As seen at FIG. 1, the perfume dispenser body 102 may have a top portion fluted area 122, and an intermediate portion fluted area 124. As shown at FIG. 2, in some embodiments, the perfume dispenser body top portion 110 and the perfume dispenser body intermediate portion 118 may be provided without fluted areas.

The perfume dispenser cap 104 may have a perfume dispenser cap top portion 130, a perfume dispenser cap first end 132, a perfume dispenser cap bottom portion 134, a perfume dispenser cap second end 136, and a perfume dispenser cap intermediate portion 138. The perfume dispenser cap 104 also includes a cap clip 140 which may be used as a pocket clip for the perfume dispenser system. In some embodiments, the cap 104 may further comprise a cap socket 142 as further described hereinbelow. As seen at FIG. 1, the perfume dispenser cap 104 may have a cap fluted area 144. As shown at FIG. 2, in some embodiments, the perfume dispenser cap 104 may be provided without fluted areas. In some embodiments, the perfume dispenser body 102 may be provided with or without fluted areas, and the perfume dispenser cap 104 may be provided with or without fluted areas.

The perfume dispenser system may comprise a delivery mechanism 150 configured to convey perfume from the perfume receptacle 108. The perfume receptacle may comprise a reservoir 170 or as described hereinbelow, a cartridge. In some embodiments, the delivery mechanism 150 may comprise a piston dispensing mechanism 152 comprising an actuation knob 154 which drives a piston 164 to push perfume out of the reservoir 170 (or cartridge) out of the delivery mechanism 150.

The delivery mechanism may comprise a piston dispensing mechanism 152 located in the perfume dispenser body 102. The piston dispensing mechanism 152 may comprise a rotatable actuation knob 154, a rod housing 158 configured to hold a reciprocating rod 160 that carries a piston 164. The rod housing 158 of the piston dispensing mechanism 152 is in fluid communication with a reservoir 170 (or cartridge) for holding a fluid perfume composition 174. In some embodiments, the rod housing 158 and the reservoir 170 are coextensive, and are separated by the piston 164. The actuation knob 154 is configured to drive the piston 164 to push perfume 174 out of the reservoir 170 (or cartridge) out of the piston dispensing mechanism 152 to an applicator 180. In response to the rotation or "dialing" of the actuation knob 154, the piston dispensing mechanism 152 pushes upward on the perfume 174 conveying the perfume 174 to an applicator 180. The actuation knob 154 of the piston dispensing mechanism 152 drives the piston 164 to push perfume 174 out of the reservoir 170 (or cartridge) to the applicator 180.

The system may further include a perfume delivery element comprising a delivery port, a delivery nozzle, or a perfume applicator located at the top of the dispenser. The delivery element may alternatively comprise a roller-ball-type delivery element. The delivery element may comprise an applicator 180 which may be any suitable applicator, such as, for example without limitation, a port or nozzle, or a rollerball applicator 182.

As seen at FIGS. 1-6, the dispenser system 100 includes a rollerball applicator 182 comprising a rollerball 194 retained for rolling movement in a rollerball housing 184. The rollerball housing 184 has a rollerball housing upper portion 186, a rollerball housing intermediate portion 188, and a rollerball housing lower portion 190. The rollerball housing 184 has a rollerball retainer seat 192 (or retainer 192) located in a rollerball housing upper portion 186, a central tubular fluid conduit 198, and lower exterior threads 200. The rollerball housing 184 is configured to be screwed into and removably retained in the dispenser body top portion 110 which is threaded to mate with the lower exterior threads 200 of the rollerball housing 184. The rollerball housing 184 further includes a series of intermediate openings 196 disposed in a rollerball housing intermediate portion 188 located below the rollerball seat or retainer 192 and above the lower exterior threads 200. The rollerball housing 184 further includes a rollerball housing gasket 202, and a rollerball housing lower lip 204.

The dispenser cap includes a socket 142 at the cap top portion 130 and the cap first end 132. The cap socket 142 is configured to receive and retain the rollerball 194 and the rollerball retainer seat 192, with the rollerball housing fins 206 retaining the rollerball housing 184 in the cap socket 142, so the dispenser cap 104 may be used as a socket wrench to rotate the rollerball housing 184 to unscrew the rollerball housing 184 from the dispenser body top portion 110. The rollerball housing intermediate openings 196 may thereby be exposed so that when the dispenser body first end 112 is submerged in a container of perfume, the intermediate openings 196 may pull the perfume into the reservoir 170 (or cartridge) to refill the dispenser.

The rollerball housing 184 has a shape that is configured to fit into the cap socket 142, with the rollerball housing fins 206 retaining the rollerball housing 184 in the cap socket 142. The rollerball housing gasket 202 is located below the rollerball retainer seat 192. The gasket 202 provides a seal between the rollerball housing 184 and the interiorly threaded dispenser body top portion 110 when the rollerball housing 184 is screwed into the dispenser body 102. The rollerball intermediate openings 196 are located below the gasket 202 and above the lower rollerball housing threads 200 so that when the rollerball housing 184 is unscrewed, the intermediate openings 196 may be exposed and used to pull in liquid during refilling of the dispenser system 100. The rollerball housing 184 is further provided with a raised rollerball housing lower lip 204 below the lower rollerball housing lower threads 200. The raised lip 204 is configured to hold the rollerball housing 184 and prevent the rollerball housing 184 from coming out of the dispenser body 102 when partially unscrewed for refilling of the dispenser system 100.

The dispenser system 100 may include a refilling mechanism as described more fully hereinbelow. The refilling mechanism may be any suitable refilling mechanism. In one embodiment, the refilling mechanism may comprise a vacuum-based extraction system capable of use to refill the reservoir or cartridge from a larger bottle.

Where the dispenser system includes a cartridge, the cartridge may be replaceable or refillable. The reservoir or cartridge may be made of a material that is compatible with or capable of use to contain multiple types of perfume compositions. The perfumes may be oil-based perfume compositions or alcohol-based perfume compositions.

The delivery mechanism and the refilling mechanism, like all the other parts of the perfume delivery system, may be made of any suitable material and fabricated by any suitable process. The reliable and durable delivery mechanism and applicator are configured to provide ease of use. Likewise, the reliable and durable refilling mechanism is configured to provide ease in refilling.

Referring to FIGS. 7-17, a second illustrative embodiment and a third illustrative embodiment are shown. As seen at FIGS. 7-12 and 16, a dispenser system 300 is shown in accordance with a second illustrative embodiment of the present invention. As seen at FIGS. 13-15 and 17, a third illustrative embodiment comprises the dispenser system 300 which is configured to receive a perfume cartridge 372 that is removable and replaceable, and refillable. Reference numerals which correspond to like elements of the dispenser system 100 heretofore described with respect to FIGS. 1-6 by a 100-299 reference numeral series, are designated by the same reference numerals in the 300-499 series in FIGS. 7-17.

Referring now to FIGS. 7-12 and 16, the perfume dispenser system 300 comprises a vacuum mechanism 410, and includes a dual function dispenser cap 304 and a dual function knob 354.

Figure 8:
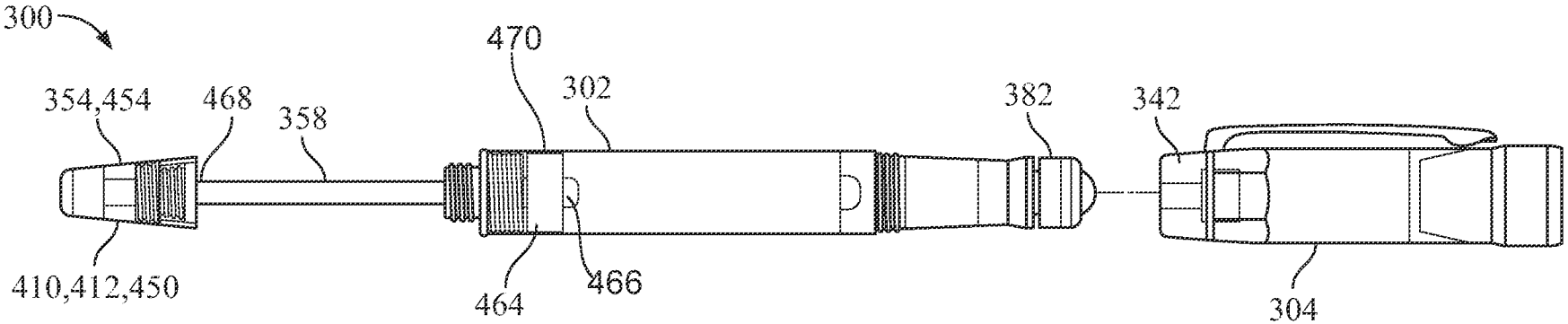
FIG. 8 presents a side elevation view of the dispenser as in FIG. 7 showing the dual function of the dispenser cap, and the dual function of the knob.
Figure 9:
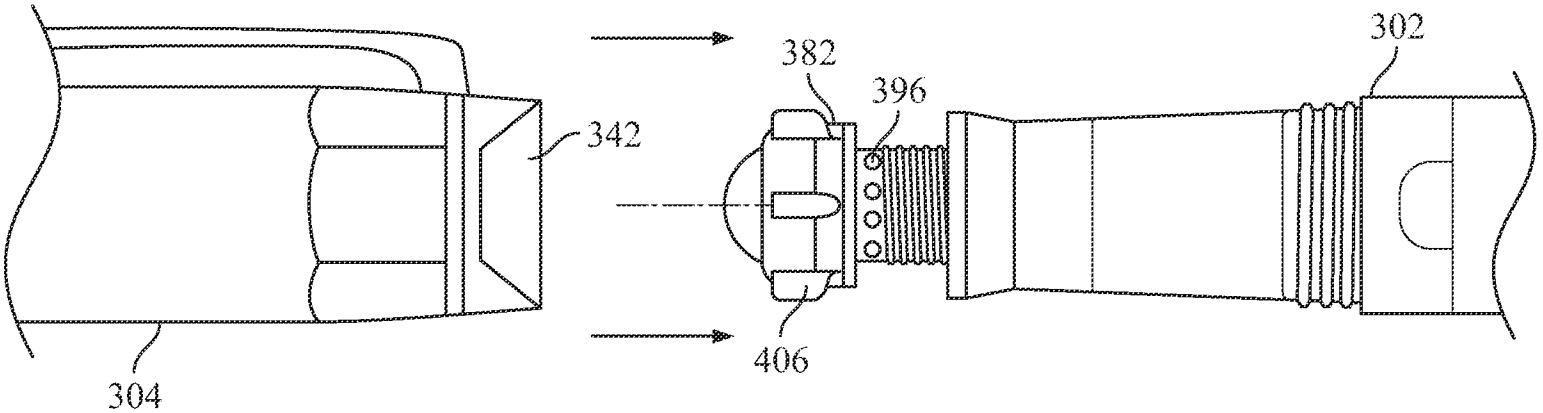
FIG. 9 presents a partial side elevation view of the dispenser as in FIG. 8 showing the dual function of the dispenser cap.
Figure 10:
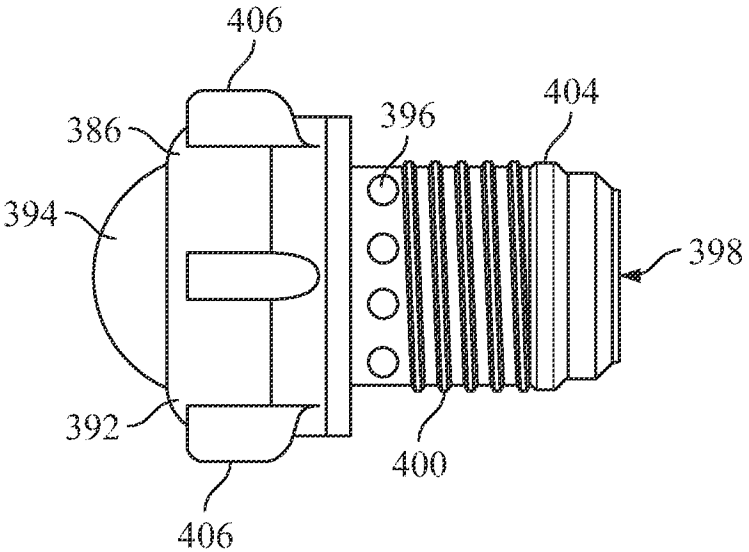
FIG. 10 presents a side elevation view of a roller ball housing and roller ball of the dispenser.
Figure 11:
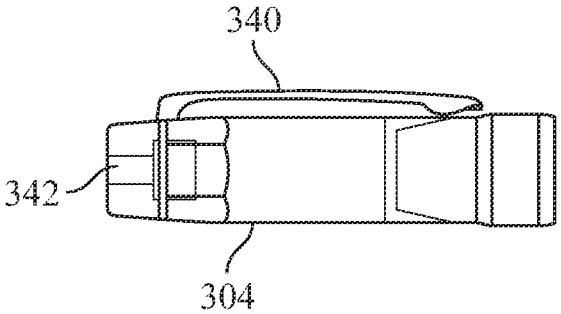
FIG. 11 presents a side elevation view of the dispenser cap.
Figure 12:
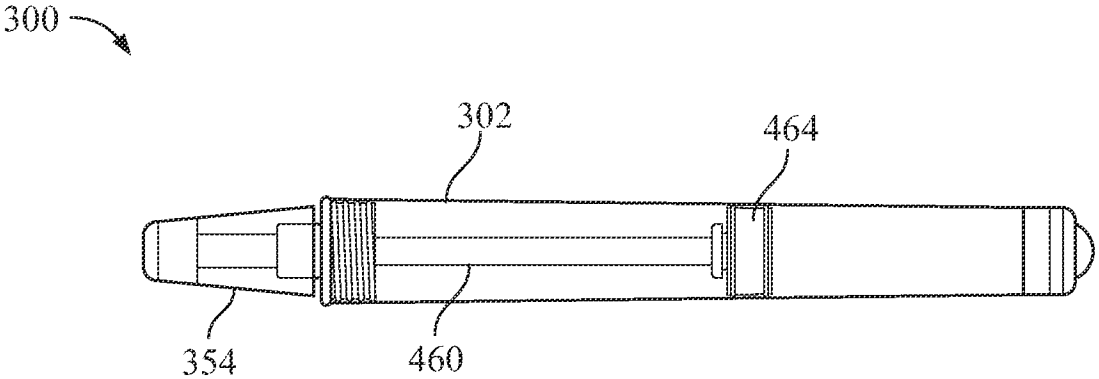
FIG. 12 presents a side elevation view of an exemplary embodiment of the present invention.
Figure 13:
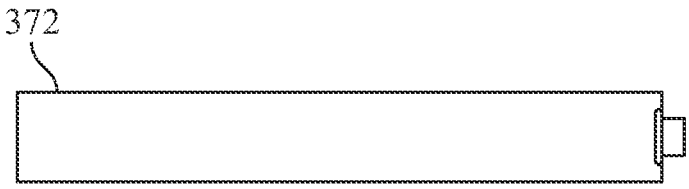
FIG. 13 presents a side elevation view of a removable, replaceable, refillable perfume cartridge for use with a third illustrative embodiment of the present invention.
Figure 14:
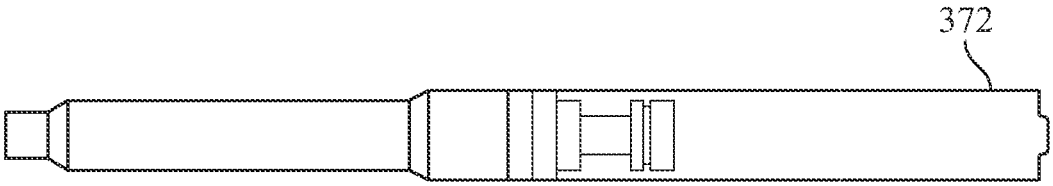
FIG. 14 presents a side elevation view of an exemplary embodiment of the present invention.
Figure 15:
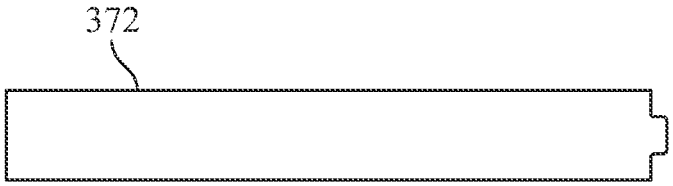
FIG. 15 presents a side elevation view of an exemplary embodiment of the present invention.
Figure 16:
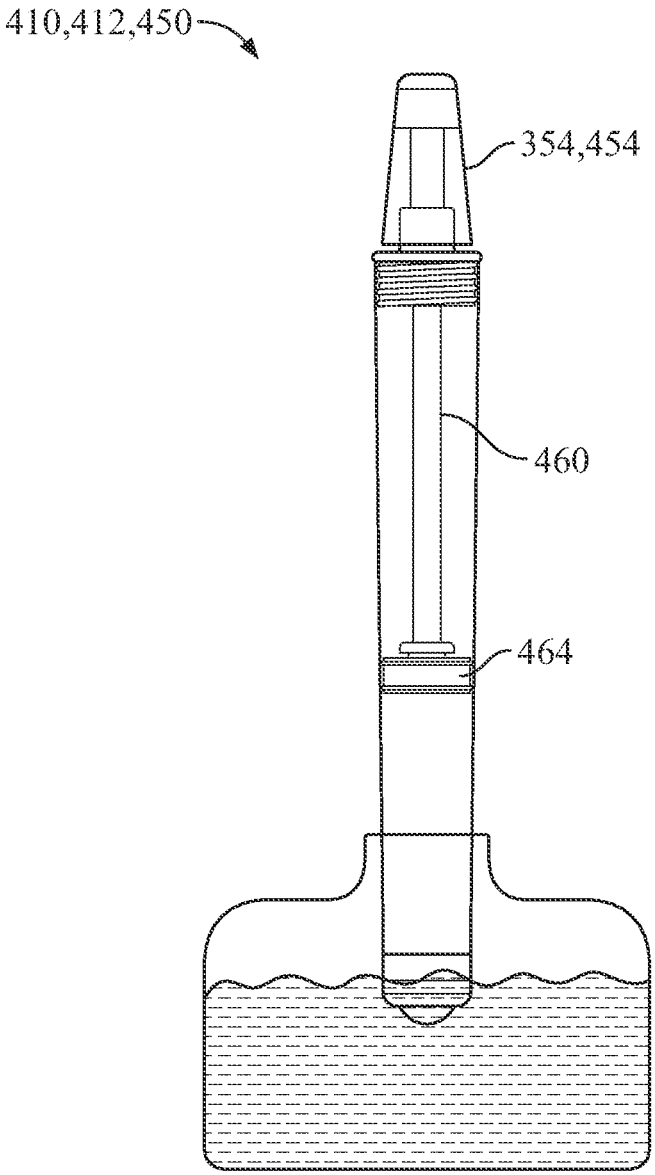
FIG. 16 presents a side elevation view of a refilling mechanism for use with the dispenser as in FIG. 7.

The perfume dispenser system 300 may further comprise a dispensing or delivery system 350. The delivery system may include at least one vacuum mechanism 410. A vacuum-based delivery system or delivery mechanism 412, and a vacuum-based refilling mechanism 450 are shown in use at FIG. 16. The dispenser may comprise a vacuum-fillable reservoir 370 or a vacuum-fillable cartridge 372 that may be filled or refilled by a user as needed with perfume or another liquid. The perfume dispenser body 302 includes a perfume reservoir 370 having a reservoir chamber 476 with a reservoir chamber interior surface 478. The vacuum-based delivery mechanism 412 may comprise a threaded handle 454 (also identified as knob 354) located at the perfume dispenser body bottom portion 314, the handle 454 being configured to be removably retained in the perfume dispenser body second end 316. Referring to FIG. 8, the threaded handle 454 is operably connected to a rod 460. The rod has a first rod end 466 and a second rod end 468. The threaded handle 454 is connected to the second rod end 468. The threaded handle 454 may be unscrewed and pulled from the dispenser body 302 thereby pulling the rod 460 out of the dispenser body 302. The first rod end 466 is operatively connected to a disc 464. The disc 464 has a disc outer edge 470 which contacts the reservoir chamber interior surface 478. When a user is ready to refill the reservoir chamber 476, the threaded handle 454 may be unscrewed, and the rod 460 may be pulled or pushed to move the disc 464. When the disc 464 is pulled up and then pushed down the movement of the disc 464 creates a vacuum pressure in the reservoir chamber 476 like a plunger of a syringe. When the disc 464 is pushed beyond a flared section of perfume dispenser body 302 the vacuum pressure is released, and liquid may be pulled into the reservoir chamber 476. When the intermediate openings 396 of the rollerball housing 384 are exposed, and the dispenser body first end 312 is submerged in the perfume, the release of the vacuum pressure results in the perfume being pulled through the intermediate openings 396 of the rollerball housing 384 and into the reservoir chamber 476.

The dispenser cap 304 includes a cap socket 342 comprising a depression on the cap top portion 330 shaped to mate with the roller ball applicator housing 384 to hold the roller ball applicator housing 384 for partial removal to expose the specialized small openings, rollerball housing intermediate openings 396. The rollerball housing intermediate openings 396 are in fluid communication with the rollerball housing central fluid conduit 398 and the reservoir chamber 476 and are capable of use to refill the reservoir chamber 476.

Figure 17:
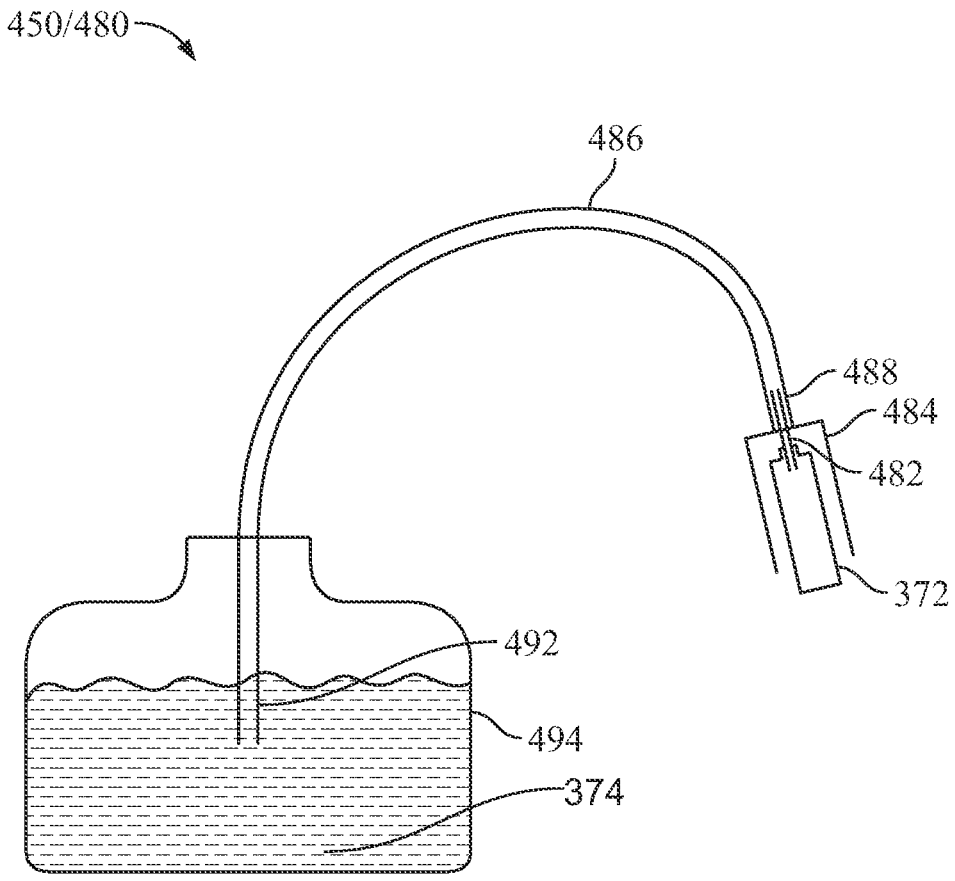
FIG. 17 presents a side elevation view of an exemplary embodiment of the present invention which may be used to fill an embodiment of the present invention as in FIG. 13.

As seen at FIGS. 13-15 and 17, a third illustrative embodiment comprises the dispenser system 300 which is configured to receive a perfume cartridge 372 that is removable and replaceable, and refillable. The perfume dispenser system 300 may be configured to receive replaceable or refillable perfume cartridges 372. The perfume cartridges 372 may be compatible with both oil-based and alcohol-based perfumes. The cartridges 372 may be separately provided. The cartridges are capable of being installed in the dispenser body. The cartridges may be attached by any suitable device. The cartridges may be attachable by a retention pin (not shown) provided in the dispenser body housing of the perfume dispenser. In accordance with the present invention, the cartridges may be filled with a user's perfume of choice using a vacuum-based refilling or extraction system 450/480 as shown at FIG. 17. The perfume dispensing system may comprise a vacuum-based filling/extraction system 450/480 capable of use to refill a refillable cartridge from a larger perfume bottle. The system comprises a cylindrical hollow vacuum needle 482 supported and carried in a vacuum hood 484, the vacuum needle 482 being operatively connected to a first end 488 of a vacuum tube 486. The vacuum tube 486 extends distally from the vacuum needle 482 and vacuum hood 484 towards a perfume container 494 or container into which a second end 492 of the vacuum tube 486 extends for delivery the perfume 374 from the container 494 to the cartridge 372. The cartridge may thereby be refilled with a perfume of the user's choice.

Figure 24:
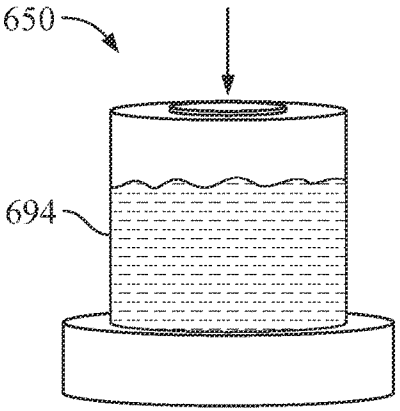
FIG. 24 presents a side elevation view of an optional filling container for holding a perfume with which a perfume cartridge may be filled in accordance with an embodiment of the present invention.
Figure 20:
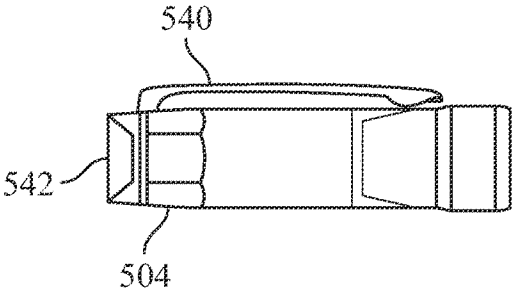
FIG. 20 presents a side cross-sectional view of a dispenser cap as in FIG. 18.

Referring now to FIGS. 18-24, a dispenser system 500 is shown in accordance with a fourth illustrative embodiment of the present invention, with FIG. 24 pertaining to a vacuum based refilling mechanism 650 including a refilling container 694. Reference numerals which correspond to like elements of the dispenser system 100 heretofore described with respect to FIGS. 1-6 by a 100-299 reference numeral series, and which correspond to like elements of the dispenser system 300 heretofore described with respect to FIGS. 7-17 by a 300-499 reference numeral series, are designated by the same reference numerals in the 500-699 series in FIGS. 18-24.

Figure 18:
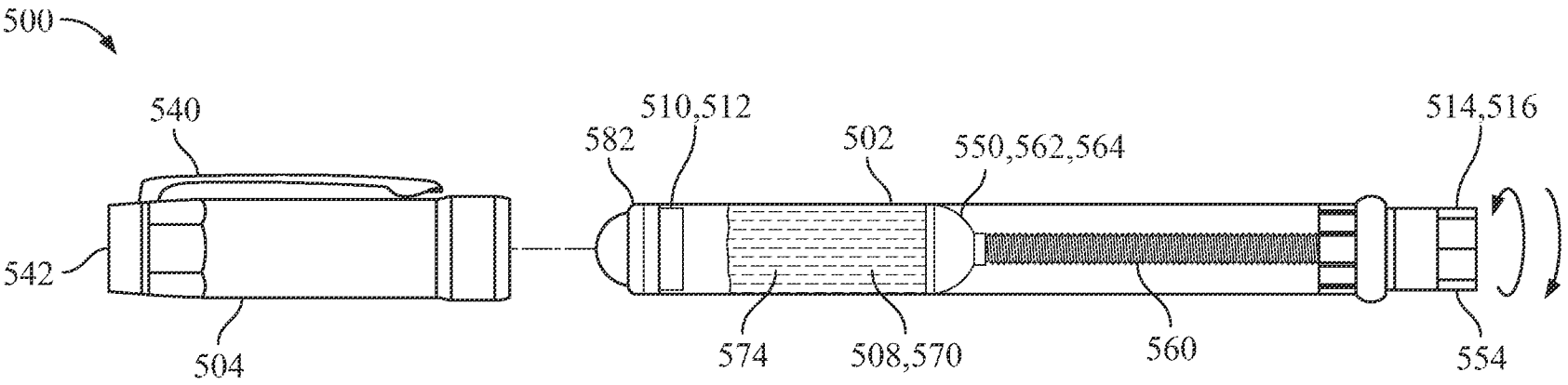
FIG. 18 presents a side elevation view of the dispenser in accordance with a fourth illustrative embodiment of the present invention.

FIG. 18 presents a side elevation view of the dispenser system 500 which comprises a piston mechanism. The perfume dispenser system 500 may have a cylindrical overall shape, and may comprise a perfume dispenser body 502 and a perfume dispenser cap 504. A perfume receptacle 508 is provided in the perfume dispenser body 502. The perfume dispenser body 502 may include a perfume dispenser body top portion 510, a perfume dispenser body first end 512, a perfume dispenser body bottom portion 514, a perfume dispenser body second end 516, and a perfume dispenser body intermediate portion 518. The perfume dispenser cap 504 may have a perfume dispenser cap top portion 530, a perfume dispenser cap first end 532, a perfume dispenser cap bottom portion 534, a perfume dispenser cap second end 536, and a perfume dispenser cap intermediate portion 538. The perfume dispenser cap 504 also includes a cap clip 540 which may be used as a pocket clip for the perfume dispenser system. In some embodiments, the dispenser cap 504 may further comprise a cap socket 542 as further described herein.

The perfume dispenser system may comprise a delivery mechanism 550 (also called dispensing mechanism 550) configured to convey perfume from the perfume receptacle 508. The perfume receptacle is a reservoir 570. The delivery mechanism 550 comprises a piston dispensing mechanism 552 comprising an actuation knob 554 which drives a piston 564 to push perfume out of the reservoir 570.

The delivery mechanism may comprise a piston dispensing mechanism 552 located in the perfume dispenser body 502. The piston dispensing mechanism 552 may comprise a rotatable actuation knob 554, a threaded reciprocating rod 560 operably connected to the rotatable actuation knob which is capable of being rotated clockwise and counterclockwise. The rod 569 carries a plunger 564 (or piston). The actuation knob 554 is configured to drive the plunger 564 to push perfume 574 out of the reservoir 570 out of the piston dispensing mechanism 552 to an applicator 580. In response to the rotation of the actuation knob 554, the piston dispensing mechanism 552 pushes upward on the perfume 574 conveying the perfume 574 to an applicator 580. The actuation knob 554 of the piston dispensing mechanism 552 drives the plunger or piston 564 to push perfume 574 out of the reservoir 570 to the applicator 580.

Applicator 580 is a rollerball applicator 582 which comprises a rollerball 594 retained for rolling movement in a rollerball housing 584. The rollerball housing 584 has a rollerball housing upper portion 586, a rollerball housing intermediate portion 588, and a rollerball housing lower portion 590. The rollerball housing 584 has a rollerball retainer seat or retainer 592 located in a rollerball housing upper portion 586, a central tubular fluid conduit 598, and lower exterior threads 600. The rollerball housing 584 is configured to be screwed into and removably retained in the dispenser body top portion 510 which is threaded to mate with the lower exterior threads 600 of the rollerball housing 584. The rollerball housing 584 further includes a series of intermediate openings 596 disposed in a rollerball housing intermediate portion 588 located below the upper rollerball seat or retainer 592 and above the lower exterior threads 600. The rollerball housing 584 further includes a rollerball housing gasket 602. The rollerball housing 584 may include a rollerball housing lower lip 604 (as best seen at 204 of FIG. 6 and 404 of FIG. 10).

The dispenser cap includes a cap socket 542 at the dispenser cap top portion 530 and the cap first end 532. The cap socket 542 is configured to receive and retain the rollerball 594 and the rollerball retainer seat 592 in the cap socket 542, so the dispenser cap 504 may be used as a socket wrench to rotate the rollerball housing 584 to unscrew the rollerball housing 584 from the dispenser body top portion 510. The rollerball housing intermediate openings 596 may thereby be exposed so that when the dispenser body first end 512 is submerged in a container of perfume, the intermediate openings 596 may pull the perfume into the reservoir 570 to refill the dispenser.

The rollerball housing 584 has a shape that is configured to fit into the cap socket 542. The rollerball housing gasket 602 is located below the rollerball retainer seat 592. The gasket 602 provides a seal between the rollerball housing 584 and the interiorly threaded dispenser body top portion 510 when the rollerball housing 584 is screwed into the dispenser body 502. The rollerball intermediate openings 596 are located below the gasket 602 and proximal to the rollerball housing threads 600 so that when the rollerball housing 584 is unscrewed, the intermediate openings 596 may be exposed and used to pull in liquid during refilling of the dispenser system 500.

Figure 23:
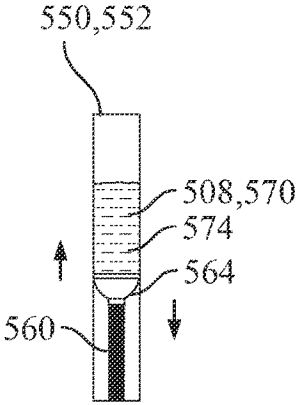
FIG. 23 presents a side elevation view of an optional filling and emptying device for use with the dispenser of the present invention.

The dispenser system 500 may include a refilling mechanism comprising a vacuum-based extraction system 650 capable of use to refill the reservoir 570 from a filling container 694 (as seen at FIGS. 23-24) into which the dispenser body top portion 510 may be immersed, as the actuation knob is rotated in a filling direction opposite the delivery direction.

Figure 19:
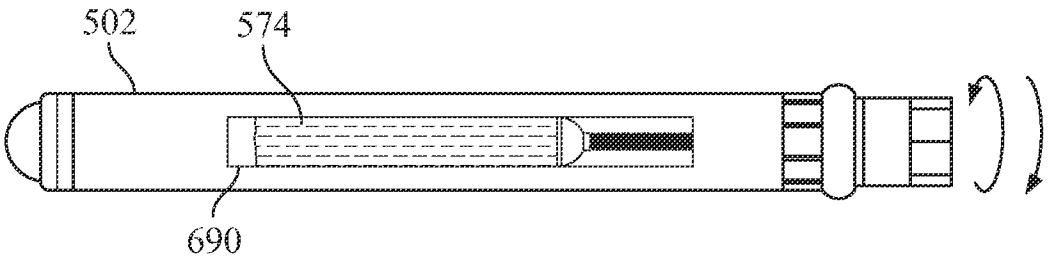
FIG. 19 presents a side elevation view of a dispenser as in FIG. 18, further comprising a view window provided in the dispenser body housing.
Figure 22:
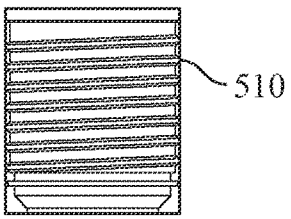
FIG. 22 presents a partial side cross-sectional view of a dispenser body top portion of a dispenser as in FIG. 18.
Figure 21:
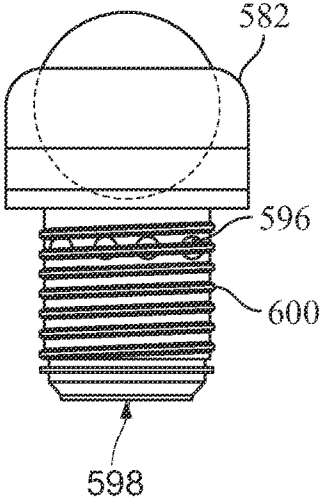
FIG. 21 presents a side elevation view of an exemplary embodiment of the present invention.

Referring to FIG. 19, in some embodiments, the perfume dispenser system 500 may comprise a dispenser body 502 which includes a clear or transparent viewing window 690 provided in the dispenser body housing 502 for use to monitor the fluid level in the reservoir (or cartridge).

Referring now to FIGS. 25-29, a dispenser and refilling system 700 is shown in accordance with a fifth illustrative embodiment of the present invention. Reference numerals which correspond to like elements of the dispenser system 100 heretofore described with respect to FIGS. 1-6 by a 100-299 reference numeral series; which correspond to like elements of the dispenser system 300 heretofore described with respect to FIGS. 7-17 by a 300-499 reference numeral series; and which correspond to like elements of the dispenser system 500 heretofore described with respect to FIGS. 18-24, are designated by the same reference numerals in the 700-899 series in FIGS. 25-29.

Figure 25:
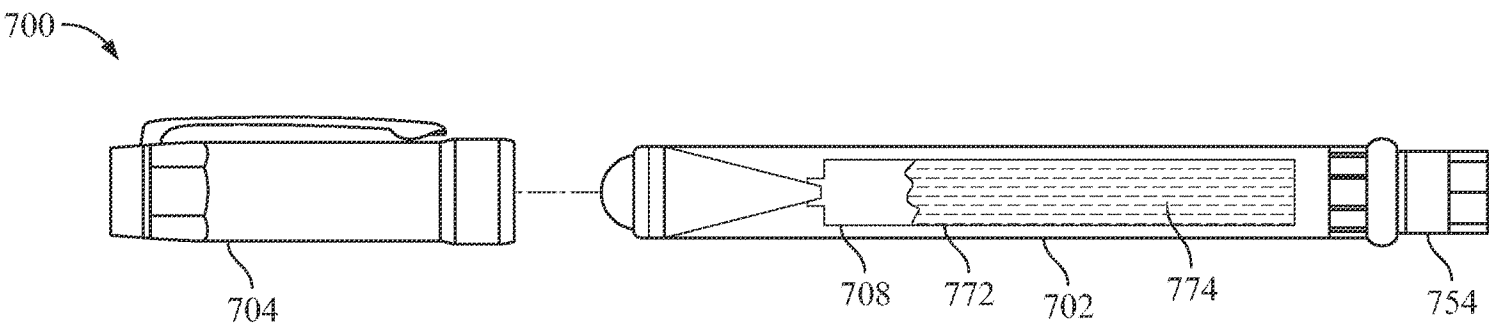
FIG. 25 presents a dispenser in accordance with a fifth illustrative embodiment of the present invention, providing a side cross-section view of the dispenser body and a side elevation view of the dispenser cap.

The perfume dispenser and refilling system 700 comprises a dispenser body 702 and the dispenser cap 704. FIG. 25 presents a side cross-section view of the dispenser body 702 and a side elevation view of the dispenser cap 704. A perfume receptacle 708 is located in the dispenser body 702. The perfume receptacle 708 may comprise an integral reservoir 770 or a removable cartridge 772. In FIGS. 25-29, the perfume receptacle shown is a removable cartridge 772.

Figure 26:
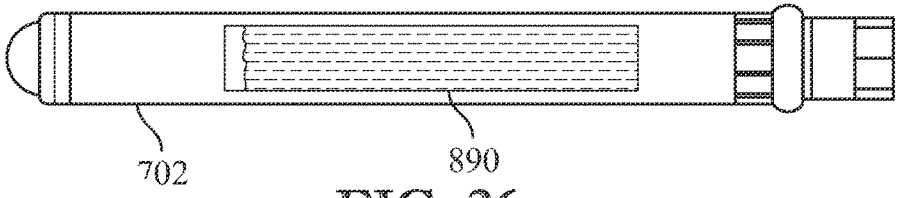
FIG. 26 presents a side elevation view of the dispenser body of a dispenser as in FIG. 25.

FIG. 26 presents a side elevation view of the dispenser body 702 showing a transparent viewing window 890 is provided in the dispenser body 702.

Figure 27:
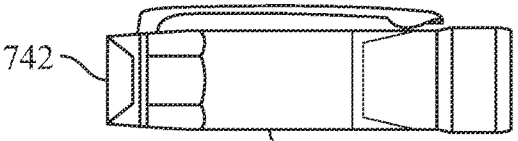
FIG. 27 presents a side cross-section view of a dispenser cap of a dispenser as in FIG. 25.

FIG. 27 presents a side cross-section view of the dispenser cap 704.

FIG. 28 presents a partial cross-sectional view of the rollerball housing 784 and the perfume cartridge 772 as in FIG. 25, enlarged to show detail. FIG. 29 presents a partial side cross-sectional view of the dispenser body top portion 710, enlarged to show detail. The rollerball housing 784 comprises a rollerball housing upper portion 786, a rollerball housing intermediate portion 788, and a rollerball housing lower portion 790. The rollerball housing 784 has a shape that is configured to fit into the cap socket 742. The rollerball housing gasket 802 is located below the rollerball retainer seat 792. The gasket 802 provides a seal between the rollerball housing 784 and the interiorly threaded dispenser body top portion 710 when the rollerball housing 784 is screwed into the dispenser body 702. A rollerball housing lower funnel 806 is located beneath and extends downwardly from the lower rollerball housing threads 800 and has a conical shape. When the rollerball housing 784 is screwed into the interiorly threaded dispenser body top portion 710, the lower funnel 806 and the lower tapered fluid conduit 808 which end in a point may pierce the top 776 of the perfume cartridge 772 so that the perfume cartridge 772 is in fluid communication with the rollerball applicator 782 for application of the perfume 774.

FIG. 30.1 provides a side elevation view of a pre-filled cartridge 972.

FIG. 30.2 presents a schematic view of an apparatus and method for filling a vacuum cartridge with perfume in accordance with a sixth embodiment of the present invention. The apparatus shown at FIG. 30.2 may be used for optional filling of a cartridge with perfume in accordance with the present invention. More particularly, FIG. 30.2 provides a schematic view of a vacuum-based extraction apparatus 1080 for filling a cartridge 972 with perfume 974. The vacuum-based extraction apparatus 1080 comprises a cylindrical hollow vacuum needle 1082 supported and carried in a vacuum hood 1084, the vacuum needle 1082 being operatively connected to a first end 1088 of a vacuum tube 1086. The vacuum tube 1086 extends distally from the vacuum needle 1082 and vacuum hood 1084 towards a beaker or container 1094 or container into which a second end 1092 extends for delivery of the perfume 974 from the beaker or container 1094. Any suitable cartridge may be refilled with a perfume of the user's choice by the apparatus and method described herein. The cartridge 972 shown at FIG. 30.1 is an example of a cartridge filled or refilled by the apparatus 1080.

Figure 31:
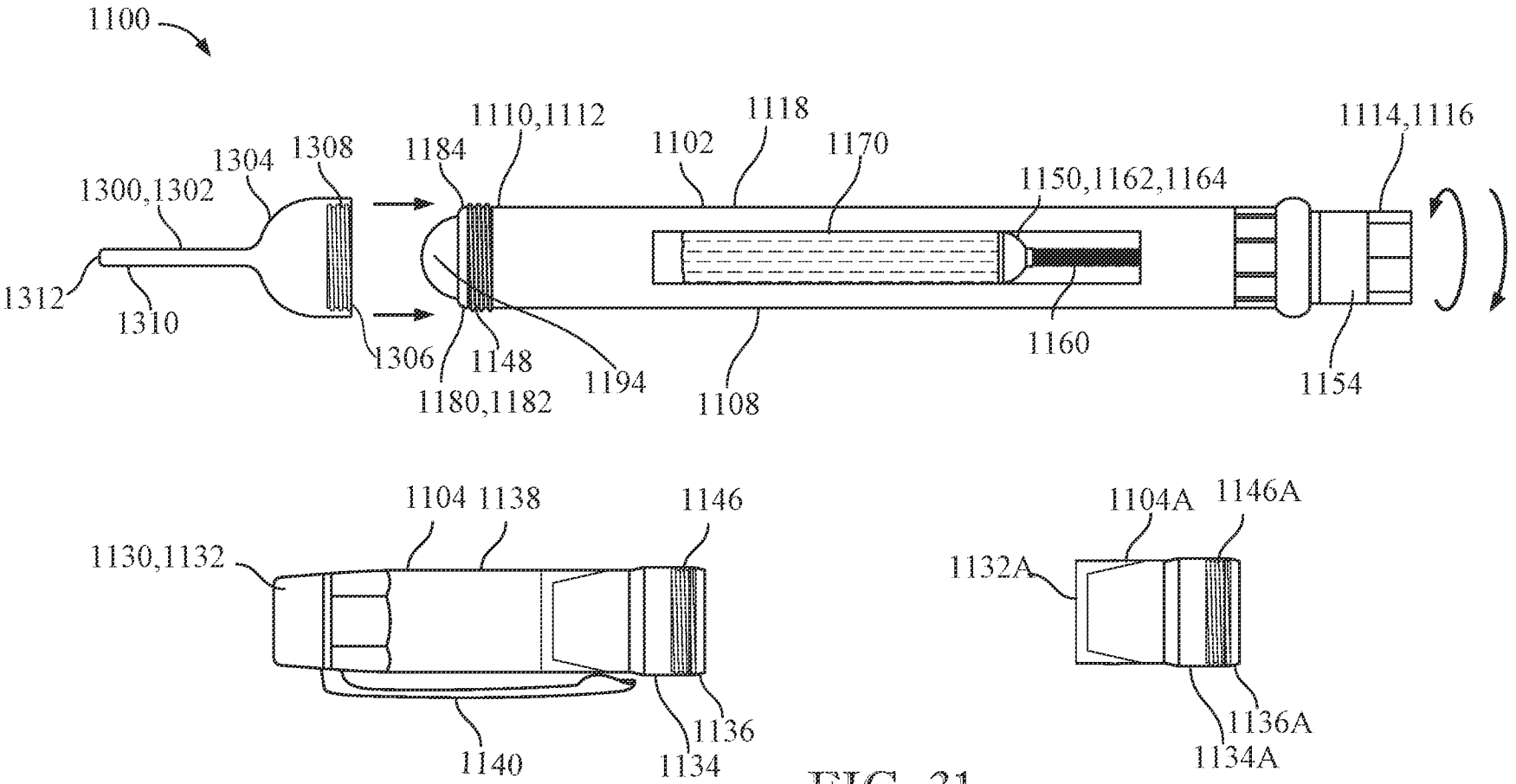
FIG. 31 presents a side elevation view of the dispenser in accordance with a seventh illustrative embodiment of the present invention.
Figure 32:
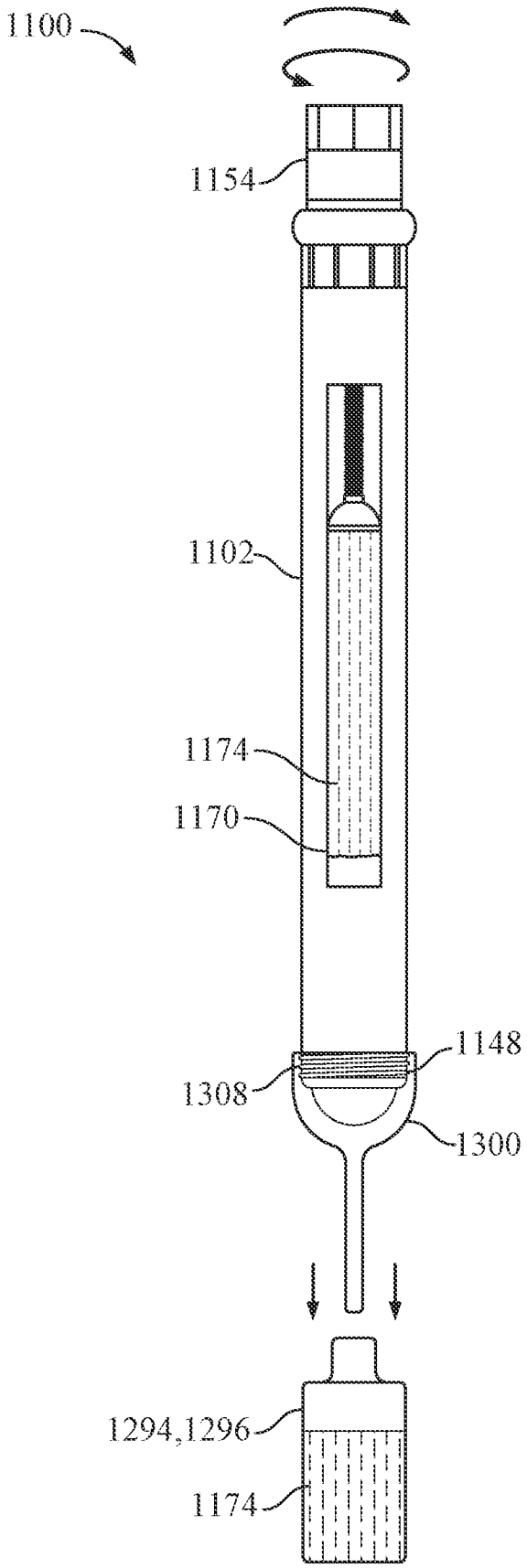
FIG. 32 presents a side elevation view of a refilling mechanism for use with the dispenser as in FIG. 31.

Referring now to FIGS. 31 and 32, FIG. 31 a refillable perfume dispenser system 1100 in accordance with a seventh illustrative embodiment of the present invention is shown. Reference numerals which correspond to like elements of the dispenser system 100 heretofore described with respect to FIGS. 1-6 by a 100-299 reference numeral series; which correspond to like elements of the dispenser system 300 heretofore described with respect to FIGS. 7-17 by a 300-499 reference numeral series; which correspond to like elements of the dispenser system 500 heretofore described with respect to FIGS. 18-24 by a 500-699 reference numeral series; and which correspond to like elements of the dispenser system 700 heretofore described with respect to FIGS. 25-29 by a 700-899 reference numeral series, are designated by the same reference numerals in the 1100-1399 series in FIGS. 31-32.

FIG. 31 presents a side elevation view of the dispenser system 1100 which has a cylindrical overall shape, The dispenser system 1100 comprises a dispenser body 1102 with a removable cap 1104,1104A and includes a refill adapter 1300 that may be removably installed on the dispenser body 1102 for use in refilling the system 1100. The refill adapter 1300 is an attachment piece comprising a funnel-shaped pipette tip adapter 1302 configured to retrieve perfume 1174 from a container 1294 such as a narrow neck perfume bottle 1296.

A perfume receptacle 1108 is provided in the perfume dispenser body 1102. The perfume dispenser body 1102 may include a perfume dispenser body top portion 1110, a perfume dispenser body first end 1112, a perfume dispenser body bottom portion 1114, a perfume dispenser body second end 1116, and a perfume dispenser body intermediate portion 1118.

The perfume dispenser may have a cap 1104,1104A with cap interior threads 1146 configured to mate with dispenser body first end exterior threads 1148. The cap 1104,1104A may be any suitable cap, for example without limitation, a cap including features described hereinabove 1104, or a cap with simple construction 1104A.

The cap 1104 may comprise a cap top portion 1130, a perfume dispenser cap first end 1132, a perfume dispenser cap bottom portion 1134, a perfume dispenser cap second end 1136, and a perfume dispenser cap intermediate portion 1138. The perfume dispenser cap 1104 also includes a cap clip 1140 which may be used as a pocket clip for the perfume dispenser system.

The perfume dispenser system 1100 may comprise a delivery mechanism 1150 (also called dispensing mechanism 1150) configured to convey perfume from the perfume receptacle 1108. The perfume receptacle is a reservoir 1170. The delivery mechanism 1150 comprises a piston dispensing mechanism 1152 located in the dispenser body 1102. The piston dispensing mechanism 1152 may comprise a rotatable actuation knob 1154, a threaded reciprocating rod 1160 operably connected to the rotatable actuation knob 1154 which is capable of being rotated clockwise and counterclockwise. The rod 1160 carries a plunger 1164 (or piston). The actuation knob 1154 is configured to drive the plunger 1164 to push perfume 1174 out of the reservoir 1170 out of the piston dispensing mechanism 1152 to an applicator 1180. In response to the rotation of the actuation knob 1154, the piston dispensing mechanism 1152 pushes upward on the perfume 1174 conveying the perfume 1174 to the applicator 1180. It can be seen the perfume dispenser system may comprise a replaceable perfume cartridge as described hereinabove.

The applicator 1180 is in fluid communication with the reservoir 1170 (or cartridge). The applicator is a rollerball applicator 1182 comprising a rollerball housing 1184 and a rollerball 1194 retained for rolling movement in the rollerball housing 1184. The rollerball housing 1184 may have any suitable construction, such as described hereinabove. The rollerball housing 1184 is configured to be removably retained in the dispenser body top portion 1110.

The dispenser may comprise a vacuum-fillable reservoir 1170 or a vacuum-fillable cartridge (as described hereinabove) that may be filled or refilled by a user as needed with perfume 1174 or another liquid. The dispenser system 1100 may include a vacuum-based refilling mechanism capable of use to refill the vacuum-refillable reservoir 1170 from a filling container 1294 (as seen at FIG. 32) into which the dispenser body top portion 1110 may be immersed, as the actuation knob 1154 is rotated in a filling direction opposite the delivery direction.

The vacuum-based refilling mechanism includes the adapter 1300 which has an adapter proximal portion 1304, an adapter proximal opening 1306, an adapter distal portion 1310 and an adapter distal opening 1312. The adapter 1300 comprises a funnel-shaped threaded pipette tip adapter 1302 having a wide funnel-shaped adapter proximal portion 1304 with interior threads 1308 near the adapter proximal opening 1306. The adapter proximal portion 1304 is constructed and arranged to be screwed onto the exterior threads 1148 at the first end 1112 of the dispenser body 1102, which are also used to screw on the removable dispenser cap 1104,1104A.

When a user is ready to refill the perfume reservoir 1170 (or cartridge), the removable cap 1104,1104A may be removed from the dispenser body 1102. The adapter 1300 may be installed on the dispenser body 1102 by screwing the adapter interior threads 1308 of the adapter proximal portion 1304 onto the dispenser body exterior threads 1148. After the adapter 1300 is installed on the dispenser body 1102, the adapter 1300 and the dispenser body may be used to refill the system 1300 with perfume 1174. The narrow distal portion 1310 of the adapter 1300 is configured for insertion in the neck of a narrow neck perfume bottle 1296 so the dispenser system 1300 may be used to draw perfume 1174 from the narrow neck perfume bottle 1296. As described herein, the actuation knob 1154 is rotated in a filling direction opposite the delivery direction. The dispenser 1100 may comprise a vacuum-fillable reservoir 1170 or a vacuum-fillable cartridge (as described hereinabove) that may be filled or refilled by a user as needed with perfume 1174 or another liquid.

The adapter 1300 provides added versatility to the perfume dispenser system 1100, enabling the perfume dispenser system to be refillable by perfume from perfume bottles with different sized openings, and perfume containers of various sizes with different sized openings.

As noted herein, the perfume delivery system and its components may be made of any suitable materials and by any suitable fabrication process.

The perfume delivery system is small and portable, and may be easily carried by the user. The portable dispenser systems described hereinabove may be used to dispense perfume or any other suitable liquid. The system may therefore be used for other purposes, i.e., to dispense any liquid having a suitable viscosity, such as, for example without limitation, serum, lotion, oil-based perfume, alcohol-based perfume. Further, the refilling system may be used as described to refill an existing perfume or liquid cartridge. The liquid may be loaded into the reservoir, or into a cartridge as described herein. The system distinguishes over previous solutions.

In summary, the present invention provides a portable perfume dispenser system. In a first implementation the portable perfume dispenser system comprises a perfume dispenser body having a perfume dispenser body top portion, a perfume dispenser body first end, a perfume dispenser body bottom portion, a perfume dispenser body second end, and a perfume dispenser body intermediate portion. The perfume dispenser system further comprises a perfume reservoir located in the perfume dispenser body, and a perfume delivery mechanism located in the perfume dispenser body, the perfume delivery mechanism being operatively connected to the perfume reservoir. The perfume dispenser system further comprises a perfume applicator removably retained in the top portion of the dispenser body, the perfume applicator in fluid communication with the perfume reservoir and the perfume delivery mechanism. The perfume dispenser system further comprises a perfume dispenser cap having a perfume dispenser cap top portion, a perfume dispenser cap first end, a perfume dispenser cap bottom portion, a perfume dispenser cap second end, the perfume dispenser cap being configured for removable placement over the top portion of the dispenser body.

In some embodiments, the perfume dispenser cap may further comprise a cap clip configured for use as a pocket clip for the perfume dispenser system.

The perfume applicator comprises an upper applicator portion, an intermediate applicator portion, and a lower applicator portion configured to be removably retained in the top portion of the dispenser body, the perfume applicator in fluid communication with the perfume reservoir and the perfume delivery mechanism. In some embodiments, the top portion of the dispenser body comprises a top portion interior threaded area and the lower applicator portion comprises a threaded lower applicator portion configured to be screwed into the top portion interior threaded area.

In some embodiments, the perfume dispenser cap further comprises a perfume dispenser cap intermediate portion, and the perfume dispenser cap top portion further comprises a cap socket configured to receive and retain the upper applicator portion so the perfume dispenser cap may be used as a socket wrench to rotate the perfume applicator to unscrew the perfume applicator for removal from the top portion of the dispenser body.

In some embodiments, the perfume applicator further comprises a gasket located the intermediate applicator portion, the gasket configured to provide a seal between the perfume applicator and the upper dispenser housing.

In some embodiments, the perfume applicator comprises a rollerball applicator configured to be removably retained in the dispenser body top portion, the rollerball applicator further comprising a rollerball housing and a rollerball retained in the rollerball housing for rolling movement therein. The rollerball housing has a rollerball housing upper portion, a rollerball housing intermediate portion and a rollerball housing lower portion. The rollerball housing further comprises a rollerball retainer seat located in the rollerball housing upper portion; a central tubular fluid conduit; and a rollerball housing lower lip.

In some embodiments, the top portion of the dispenser body comprises a top portion interior threaded area, and the rollerball housing lower portion comprises an exteriorly threaded rollerball housing lower portion configured to be screwed into the top portion interior threaded area.

In some embodiments, the rollerball housing further includes a series of intermediate openings disposed in the rollerball housing intermediate portion located below the rollerball retainer seat.

In some embodiments, the rollerball applicator further comprises a rollerball housing gasket carried on the rollerball housing.

In some embodiments, the perfume dispenser cap further comprises a perfume dispenser cap intermediate portion, and the perfume dispenser cap top portion further comprises a cap socket configured to receive and retain the rollerball housing upper portion so the perfume dispenser cap may be used as a socket wrench to rotate the rollerball applicator to unscrew the rollerball perfume applicator for removal from the top portion of the dispenser body.

In some embodiments, the rollerball housing further comprises a plurality of rollerball housing fins configured to retain the rollerball housing in the cap socket.

In some embodiments, the perfume dispenser system further comprises a refilling mechanism.

The perfume delivery mechanism may comprise a piston dispensing mechanism further comprising a reciprocating rod, a piston, and a rotatable actuation knob operatively connected to the reciprocating rod and the piston. The rotatable actuation knob is configured to drive the piston in response to rotation of the rotatable actuation knob in a delivery direction to push perfume out of the reservoir to the perfume applicator for delivery of the perfume. The reservoir may further comprise a removable perfume cartridge.

The perfume dispenser system may further comprise a vacuum-based refilling mechanism constructed and arranged to be removably installed on the top portion of the dispenser body. The vacuum-based refilling mechanism comprises the perfume delivery mechanism and a removable refill adapter having an adapter proximal portion, an adapter proximal opening, an adapter distal portion and an adapter distal opening. The top portion of the dispenser body may comprise a top portion exteriorly threaded area. The perfume dispenser cap may comprise an interiorly threaded perfume dispenser cap constructed and arranged to be removably screwed onto the top portion exteriorly threaded area of the dispenser body. The removable refill adapter may comprise a funnel-shaped interiorly threaded pipette tip adapter, the adapter proximal portion comprising a wide funnel-shaped adapter proximal portion that is interiorly threaded near the adapter proximal opening. The adapter proximal portion is constructed and arranged to be screwed onto the top portion exteriorly threaded area of the dispenser body. The adapter distal portion is configured to be insertable in a perfume container for refilling of the perfume delivery system. The rotatable actuation knob operatively connected to the reciprocating rod and the piston, is configured to drive the piston in response to rotation of the rotatable actuation knob in a refilling direction to pull perfume from the perfume container into the perfume reservoir.

In one embodiment, the present invention provides a portable perfume dispenser system comprising:

- a perfume dispenser body having a perfume dispenser body top portion, a perfume dispenser body first end, a perfume dispenser body bottom portion, a perfume dispenser body second end, and a perfume dispenser body intermediate portion;
- a perfume reservoir located in the perfume dispenser body;
- a perfume delivery system located in the perfume dispenser body, the perfume delivery system being operatively connected to the perfume reservoir;
- a perfume applicator comprising an upper applicator portion, an intermediate applicator portion, and a lower threaded portion configured to be screwed into and removably retained in the top portion of the dispenser body, the perfume applicator in fluid communication with the perfume reservoir and the perfume delivery system; and
- a perfume dispenser cap having a perfume dispenser cap top portion, a perfume dispenser cap first end, a perfume dispenser cap bottom portion, a perfume dispenser cap second end;
- a perfume delivery mechanism comprising:
  - a reciprocating rod;
  - a piston; and
  - a rotatable actuation knob operatively connected to the reciprocating rod and the piston, and configured to drive the piston in response to rotation of the rotatable actuation knob in a delivery direction to push perfume out of the reservoir to the perfume applicator for delivery of the perfume; and a vacuum-based refilling mechanism comprising:

the perfume delivery mechanism; and a removable refill adapter having an adapter proximal portion, an adapter proximal opening, an adapter distal portion and an adapter distal opening;

wherein the top portion of the dispenser body comprises a top portion exteriorly threaded area;

wherein the perfume dispenser cap comprises an interiorly threaded perfume dispenser cap constructed and arranged to be removably screwed onto the top portion exteriorly threaded area of the dispenser body;

wherein the adapter comprises a funnel-shaped interiorly threaded pipette tip adapter, the adapter proximal portion comprising a wide funnel-shaped adapter proximal portion that is interiorly threaded near the adapter proximal opening;

wherein the adapter proximal portion is constructed and arranged to be screwed onto the top portion exteriorly threaded area of the dispenser body;

wherein the adapter distal portion is configured to be insertable in a perfume container for refilling of the perfume delivery system; and wherein the rotatable actuation knob operatively connected to the reciprocating rod and the piston, is configured to drive the piston in response to rotation of the rotatable actuation knob in a refilling direction to pull perfume from the perfume container into the perfume reservoir.

The reservoir may comprise a removable perfume cartridge.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A portable perfume dispenser system comprising:

a perfume dispenser body;

a perfume reservoir located in the perfume dispenser body;

a perfume delivery mechanism at least partially disposed in the perfume dispenser body, the perfume delivery mechanism being operatively connected to the perfume reservoir;

a perfume applicator coupled to the dispenser body, the perfume applicator including a rollerball housing and a roller applicator rotatably mounted to the roller housing, the rollerball housing defining a fluid conduit in fluid communication with the perfume reservoir for delivering the perfume from the perfume reservoir to the roller, the rollerball housing including one or more side openings in a side wall thereof and in fluid communication with the fluid conduit, the perfume applicator axially movable between an operative position to permit dispensing of the perfume through the roller applicator and a fill position to expose the one or more side openings to permit refilling of the perfume reservoir with perfume through the one or more openings, the perfume applicator coupled to the dispenser body when in the operative position and the fill position; and a perfume dispenser cap configured for removable placement over the roller of the perfume applicator.

2. The perfume dispenser system of claim 1 wherein the perfume applicator comprises a rollerball applicator, the rollerball applicator further comprising:

a rollerball housing having a rollerball housing upper portion, a rollerball housing intermediate portion and a rollerball housing lower portion, the rollerball housing further comprising:

a rollerball retainer seat located in the rollerball housing upper portion;

a central tubular fluid conduit; and a rollerball housing lower lip; and a rollerball retained in the rollerball housing for rolling movement in the rollerball housing.

3. The perfume dispenser system of claim 2 wherein:

the dispenser body comprises a top portion having an interior threaded area; and the rollerball housing lower portion comprises an exteriorly threaded rollerball housing lower portion configured to be screwed into the interior threaded area of the top portion of the dispenser body.

4. The perfume dispenser system of claim 3 wherein the perfume dispenser cap further comprises a perfume dispenser cap intermediate portion, and the perfume dispenser cap top portion further comprises a cap socket configured to receive and retain the rollerball housing upper portion so the perfume dispenser cap may be used as a socket wrench to rotate the rollerball applicator to unscrew the rollerball perfume applicator for removal from the top portion of the dispenser body.

5. The perfume dispenser system of claim 4 wherein the rollerball housing further comprises a plurality of rollerball housing fins configured to retain the rollerball housing in the cap socket.

6. The perfume dispenser system of claim 2 wherein the rollerball housing further includes a series of intermediate openings disposed in the rollerball housing intermediate portion located below the rollerball retainer seat, the one or more side openings including the series of side openings.

7. The perfume dispenser system of claim 1 wherein the perfume delivery mechanism comprises a piston dispensing mechanism further comprising:

a reciprocating rod;

a piston; and a rotatable actuation knob operatively connected to the reciprocating rod and the piston, and configured to drive the piston in response to rotation of the rotatable actuation knob in a delivery direction to push perfume out of the reservoir to the perfume applicator for delivery of the perfume.

8. The perfume dispenser system of claim 7 wherein the reservoir further comprises a removable perfume cartridge.

9. The perfume dispenser system of claim 7 further comprising a vacuum-based refilling mechanism constructed and arranged to be removably installed on the top portion of the dispenser body.

10. The perfume dispenser system of claim 9 wherein the vacuum-based refilling mechanism comprises:

the perfume delivery mechanism; and a removable refill adapter having an adapter proximal portion, an adapter proximal opening, an adapter distal portion and an adapter distal opening.

11. The perfume dispenser system of claim 10 wherein the top portion of the dispenser body comprises a top portion exteriorly threaded area, and wherein the perfume dispenser cap comprises an interiorly threaded perfume dispenser cap constructed and arranged to be removably screwed onto the top portion exteriorly threaded area of the dispenser body.

12. The perfume dispenser system of claim 11:

wherein the removable refill adapter comprises a funnel-shaped interiorly threaded pipette tip adapter, the adapter proximal portion comprising a wide funnel-shaped adapter proximal portion that is interiorly threaded near the adapter proximal opening;

wherein the adapter proximal portion is constructed and arranged to be screwed onto the top portion exteriorly threaded area of the dispenser body;

wherein the adapter distal portion is configured to be insertable in a perfume container for refilling of the perfume delivery system; and wherein the rotatable actuation knob operatively connected to the reciprocating rod and the piston, is configured to drive the piston in response to rotation of the rotatable actuation knob in a refilling direction to pull perfume from the perfume container into the perfume reservoir.

13. The perfume dispenser system of claim 1 wherein the rollerball housing is threadably coupled to the perfume dispenser body, and is rotatable relative to the perfume dispenser body to axially move the perfume applicator between the operative position and the fill position.

14. A portable perfume dispenser system comprising:

a perfume dispenser body having a perfume dispenser body top portion, a perfume dispenser body first end, a perfume dispenser body bottom portion, a perfume dispenser body second end, and a perfume dispenser body intermediate portion;

a perfume reservoir located in the perfume dispenser body;

a perfume delivery system located in the perfume dispenser body, the perfume delivery system being operatively connected to the perfume reservoir;

a perfume applicator comprising an upper applicator portion, an intermediate applicator portion, and a lower threaded portion configured to be screwed into and removably retained in the top portion of the dispenser body, the perfume applicator in fluid communication with the perfume reservoir and the perfume delivery system;

a perfume dispenser cap having a perfume dispenser cap top portion, a perfume dispenser cap first end, a perfume dispenser cap bottom portion, a perfume dispenser cap second end;

a perfume delivery mechanism comprising:

a reciprocating rod;

a piston; and a rotatable actuation knob operatively connected to the reciprocating rod and the piston, and configured to drive the piston in response to rotation of the rotatable actuation knob in a delivery direction to push perfume out of the reservoir to the perfume applicator for delivery of the perfume; and a vacuum-based refilling mechanism comprising:

the perfume delivery mechanism; and a removable refill adapter having an adapter proximal portion, an adapter proximal opening, an adapter distal portion and an adapter distal opening;

wherein the top portion of the dispenser body comprises a top portion exteriorly threaded area;

wherein the perfume dispenser cap comprises an interiorly threaded perfume dispenser cap constructed and arranged to be removably screwed onto the top portion exteriorly threaded area of the dispenser body;

wherein the adapter comprises a funnel-shaped interiorly threaded pipette tip adapter, the adapter proximal portion comprising a wide funnel-shaped adapter proximal portion that is interiorly threaded near the adapter proximal opening;

wherein the adapter proximal portion is constructed and arranged to be screwed onto the top portion exteriorly threaded area of the dispenser body;

wherein the adapter distal portion is configured to be insertable in a perfume container for refilling of the perfume delivery system; and wherein the rotatable actuation knob operatively connected to the reciprocating rod and the piston, is configured to drive the piston in response to rotation of the rotatable actuation knob in a refilling direction to pull perfume from the perfume container into the perfume reservoir.

15. The perfume dispenser system of claim 14 wherein the reservoir further comprises a removable perfume cartridge.

16. A portable perfume dispenser system comprising:

a perfume dispenser body and having a perfume reservoir and defining a longitudinal axis;

a perfume applicator coupled to the dispenser body, the perfume applicator including an applicator housing and an applicator member mounted to the applicator housing, the applicator housing defining a fluid conduit configured to be in fluid communication with the perfume reservoir and the applicator member for delivering the perfume from the perfume reservoir to the applicator member, the applicator housing including one or more openings in a side wall thereof and in fluid communication with the fluid conduit, the applicator housing movable between an operative position to permit dispensing of the perfume through the applicator member and a fill position to expose the one or more openings to permit refilling of the perfume reservoir with perfume through the one or more openings;

a perfume delivery mechanism at least partially disposed in the perfume dispenser body, the perfume delivery mechanism including an actuator and a piston operatively coupled to the actuator and disposed in the perfume reservoir of the perfume dispenser body, the piston movable in a first longitudinal direction to distribute perfume from the perfume reservoir to the applicator member when in the operative position of the of the applicator housing and movable in a second longitudinal direction to draw perfume under vacuum from a perfume source through the one or more openings when in the fill position of the applicator housing to at last partially fill the perfume reservoir; and an enclosure member configured for removable placement over at least the applicator member of the perfume applicator;

wherein the applicator housing is threadably coupled to the perfume dispenser body, and is rotatable relative to the perfume dispenser body to axially move between the operative position and the fill position.

17. The portable perfume dispenser system of claim 16 wherein the enclosure member is cooperatively engageable with the applicator housing of the perfume applicator, the enclosure member rotatable to cause corresponding rotational movement of the applicator housing to axially move the applicator housing between the operative position and the fill position.

18. The portable perfume dispenser system of claim 17 wherein the enclosure member includes an internal lumen in fluid communication with the one or more openings of the applicator housing when in the fill position of the applicator housing, the enclosure member configured to be in communication with a perfume source to enable filling of the perfume reservoir when the movable piston is moved in the second longitudinal direction to draw perfume through the internal lumen under vacuum and through the one or more openings of the applicator housing.

19. The portable perfume dispenser system of claim 18 wherein the actuator of the perfume delivery mechanism is rotatable in a first rotatable direction to move the position in the first longitudinal direction to dispense the perfume from the applicator member and is movable in a second rotatable direction to move the piston in the second longitudinal direction to draw the perfume under vacuum from the perfume source.

20. The portable perfume dispenser system of claim 19 wherein the applicator member of the perfume delivery mechanism is a rotatable member.

21. The perfume dispenser system of claim 19 wherein the dispenser body includes an internal threaded portion and the applicator housing includes an external threaded portion to threadably couple the applicator housing to the perfume dispenser body, and enable axially movement of the applicator housing between the operative position and the fill position.

* * * * *